US012414627B2

(12) United States Patent
Crudo

(10) Patent No.: US 12,414,627 B2
(45) **Date of Patent: *Sep. 16, 2025**

(54) TOTE TRAY HOLDER FOR USE WITH WHEELCHAIR-ACCESSIBLE, HEAVY-DUTY, TABLE

(71) Applicant: NPS Public Furniture Corp., Clifton, NJ (US)

(72) Inventor: Alexander Crudo, Hoboken, NJ (US)

(73) Assignee: NPS Public Furniture Corp., Clifton, NJ (US)

( * ) Notice: Subject to any disclaimer, the term of this patent is extended or adjusted under 35 U.S.C. 154(b) by 139 days.

This patent is subject to a terminal disclaimer.

(21) Appl. No.: 18/409,961

(22) Filed: Jan. 11, 2024

(65) Prior Publication Data

US 2025/0228358 A1 Jul. 17, 2025

(51) Int. Cl.
*A47B 17/06* (2006.01)
*A47B 7/00* (2006.01)
*A47B 88/40* (2017.01)

(52) U.S. Cl.
CPC ..... *A47B 17/06* (2013.01); *A47B 7/00* (2013.01); *A47B 88/402* (2017.01); *A47B 2210/0002* (2013.01)

(58) Field of Classification Search
CPC ..... A47B 17/06; A47B 88/402; A47B 7/00; A47B 2210/002; A47B 2210/15; A47B 13/16; A47B 13/06; A47B 2021/0335; A47B 21/03; A47B 2013/085
USPC ..... 108/26, 143, 25; 312/246, 212
See application file for complete search history.

(56) References Cited

U.S. PATENT DOCUMENTS 3,285,683 A * 11/1966 Middleton ..... A24F 19/08 312/246
3,351,404 A * 11/1967 Blake ..... B60N 3/083 312/246
3,460,876 A * 8/1969 De Boer ..... B60N 3/083 312/246
3,586,394 A * 6/1971 Hecksel ..... A47B 88/497 312/246
3,590,754 A * 7/1971 Jakobsen ..... A47B 13/083 52/800.11

(Continued)

OTHER PUBLICATIONS

"Cascade Tote Trays," https://smithsystem.com/furniture/tote-trays/, Smith System, Retrieved on Dec. 19, 2023.

(Continued)

*Primary Examiner* — Janet M Wilkens
(74) *Attorney, Agent, or Firm* — Weiss & Arons LLP

(57) ABSTRACT

A wheelchair-accessible heavy-duty table with tote tray holder assembly is provided. The tote tray holder may be disposed in the wheelchair-accessible heavy-duty table. The tote tray holder may have a metal frame. The metal frame may have a flat top portion and two side portions. Each of the two side portions of the metal frame may include an elongated portion and a c-shaped detent. The tote tray holder may be configured to be mounted to the bottom side of the tabletop. The tote tray holder may hold a tote tray. The c-shaped detent of each of the two side portions of the tote tray holder may be further configured with a fold tab to hold the tote tray level when the tote tray is pulled out up to about 2 inches before the end of the tote tray.

19 Claims, 38 Drawing Sheets

(56) References Cited

U.S. PATENT DOCUMENTS

| | | | | |
|---|---|---|---|---|
| 3,694,048 | A * | 9/1972 | Middleton | A47B 88/57 312/246 |
| 4,736,689 | A * | 4/1988 | Stanko | A47B 21/0314 312/246 |
| 5,622,120 | A * | 4/1997 | Yeh | A47B 13/021 108/158 |
| 6,056,378 | A * | 5/2000 | Semon | A47B 88/407 312/246 |
| 7,077,364 | B2 * | 7/2006 | Hendzel | B07C 3/008 312/246 |
| 7,963,408 | B2 * | 6/2011 | Glover | A47B 88/57 312/334.7 |
| 9,456,691 | B2 * | 10/2016 | Tang | A47B 88/57 |
| 11,992,118 | B1 * | 5/2024 | Crudo | A47B 13/06 |
| 2002/0129746 | A1 * | 9/2002 | Donnelly | A47B 21/03 108/25 |
| 2004/0089625 | A1 * | 5/2004 | Tsai | A47B 88/402 211/126.15 |
| 2015/0144035 | A1 * | 5/2015 | Molteni | A47B 88/477 108/26 |
| 2021/0018028 | A1 * | 1/2021 | Hutson | F16B 12/10 |

OTHER PUBLICATIONS

"LOBO Tables," https://wibenchmfg.com/products/tables/work-tables/lobo-tables/, WB Manufacturing, Retrieved on Dec. 19, 2023.
"Planner Trespa: 30"×60" Science Table Model #: 11288," https://smithsystem.com/wp-content/uploads/2017/09/ss_11288trespa_2018.pdf, Smith System, Jun. 2018.
"Tote Tray for 4000 Series Activity Tables," https://www.schoolsin.com/vir-utote.html, SchoolsIn, Retrieved on Dec. 19, 2023.
"Heavy-Duty Activity Tables," https://res.cloudinary.com/da3rom333/image/upload/y1699033710/Product%20Assets/Literature/Sell%20Sheets/SellSheet_NPS_Heavy_Duty_Activity_Tables_Series_txayaf.pdf, National Public Seating, Retrieved on Dec. 19, 2023.
"Heavy Duty Designer Tables," https://res.cloudinary.com/da3rom333/image/upload/v1699033710/Product%20Assets/Literature/Sell%20Sheets/SellSheet_NPS_Heavy_Duty_Designer_Tables_Series_iaadd7.pdf. National Public Seating, Retrieved on Dec. 19, 2023.

* cited by examiner

TOTE TRAY HOLDER FOR USE WITH WHEELCHAIR-ACCESSIBLE, HEAVY-DUTY, TABLE

FIELD OF TECHNOLOGY

Aspects of the disclosure relate to functional mechanical designs and apparatus.

BACKGROUND OF THE DISCLOSURE

Functional furniture plays an important role in everyday activities. Exemplary activities may relate to the workplace, the home, retail locations, office settings, educational locations, eateries, leisure, and any other activity that may utilize furniture such as a table.

Heavy-duty tables are designed to provide additional support in order to carry heavy loads and endure excessive use over time. Heavy-duty tables are used in a variety of applications.

Typically, heavy-duty tables include table supports. A table support generally comprises a frame that is mounted to a tabletop of the heavy-duty table. The frame typically includes an apron that extends significantly below the tabletop. Because the frame extends below the tabletop, the frame may obstruct clearance under the table. Because the frame extends below the tabletop, access under the table may be limited and the heavy-duty table may not comply with the Americans with Disabilities Act ("ADA").

Tote tray holder features may increase the utility of functional furniture such as a table. A tote tray holder, for the purposes of this patent application, may be understood to refer to a storage device having a base fixedly attached to the underside of the table.

It would be desirable to provide apparatus, systems, and methods for supporting heavy-duty tables without compromising on clearance under the table. It would be further desirable to provide a heavy-duty table that is ADA compliant while maintaining adequate support.

It would be further desirable to provide improved structural characteristics for wheelchair-accessible heavy-duty tables in order to enable the tables to accommodate sliding tote trays as described herein. It would be further desirable for the tote tray holders to be associated with high structural strength and performance.

SUMMARY OF THE DISCLOSURE

Aspects of the disclosure relate to a wheelchair-accessible heavy-duty table with a tote tray holder, and/or associated support mechanisms related thereto. A support mechanism may support one or more tote trays and facilitate handling of same.

Apparatus and methods may enable mounting of one or more tote trays under a tabletop. Apparatus and methods may apply to any suitable table. Apparatus and methods may apply to any table that does not have a tote tray holder. Apparatus and methods may enable mounting of a tote tray in any suitable way desired by a customer.

Apparatus and methods may enable mounting of a tote tray that may hold more weight than a plastic tote tray. Apparatus and methods may enable mounting a tote tray that may hold a tray level when pulled out until about 2 inches before the end of the tote tray. The use of the term "about" may refer to up to ±5% or less of all measurements set forth herein.

Apparatus and methods may enable a design of tote tray holder detents for slidably supporting edges of a tote tray. The tote tray holder detents may be c-shaped. Apparatus and methods may enable the tote tray holder to be made of one piece of material. Apparatus and methods may enable the tote tray to be made of one piece of material.

Apparatus and methods may include a plastic-only tote tray. Apparatus and methods may include a polypropylene tote tray. Apparatus and methods may include a translucent tote tray. Apparatus and methods may include a metal-only tote tray holder. Apparatus and methods may include a tote tray holder made of 14-gauge steel. Apparatus and methods may allow for no plastic in the tote tray holder. Apparatus and methods may allow for no metal in the tote tray.

Apparatus and methods may include pulling the tote tray almost completely out of the tote tray holder while preventing the tote tray from disengaging the tote tray holder. Apparatus and methods may enable the tote tray holder to be mounted adjacent to the table apron. Because the apron may be about 6 millimeters ("mm") or less in depth in the embodiments set forth herein, the tote tray may still be pulled out without being blocked by the apron in tables, as it typically would be blocked by the apron in conventional heavy-duty tables.

BRIEF DESCRIPTION OF THE DRAWINGS

The objects and advantages of the disclosure will be apparent upon consideration of the following detailed description, taken in conjunction with the accompanying drawings, in which like reference characters refer to like parts throughout, and in which.

The figures show illustrations for a tote tray holder in a wheelchair-accessible heavy-duty table.

DETAILED DESCRIPTION OF THE DISCLOSURE

Apparatus and methods may enable mounting of a tote tray under a tabletop. Apparatus and methods may apply to any suitable heavy-duty table. Apparatus and methods may apply to any table that does not have a tote tray holder. Apparatus and methods may enable mounting of a tote tray in any way desired by a customer.

Apparatus and methods may enable mounting of a tote tray that may hold more weight than a plastic tote tray. Apparatus and methods may enable mounting a tote tray holding a tray level when pulled out until about 2 inches before the end of the tote tray.

Apparatus and methods may include a design of tote tray holder detents. The tote tray holder detents may be in the form of c-shaped detents. C-shaped detents are bent structures having at least three sides (e.g., a top side, bottom side, and right or left side).

Apparatus and methods may allow for no plastic in the tote tray holder. Apparatus and methods may allow for only plastic in the tote tray.

Apparatus and methods may include a tote tray holder made of one piece of material. Apparatus and methods may include a tote tray made of one piece of material.

Apparatus and methods may enable the tote tray to be pulled almost completely out of the tote tray holder, preventing the tote tray from falling out of the tote tray holder. Apparatus and methods may enable the tote tray holder to be mounted adjacent to the apron. Because the apron may be about 6 mm in depth, the tote tray may be pulled out without being blocked by the apron, as it would be blocked by the apron in a conventional heavy-duty table.

Apparatus and methods described herein are illustrative. Apparatus and methods in accordance with this disclosure will now be described in connection with the figures, which form a part hereof. The figures show illustrative features of apparatus and method steps in accordance with the principles of this disclosure. It is understood that other embodiments may be utilized, and that structural, functional, and procedural modifications may be made without departing from the scope and spirit of the present disclosure.

Aspects of the disclosure relate to a tote tray holder and/or associated support mechanisms. A support mechanism may support the tote tray holder and facilitate insertion and removal of a tote tray from the tote tray holder.

Figure 1:
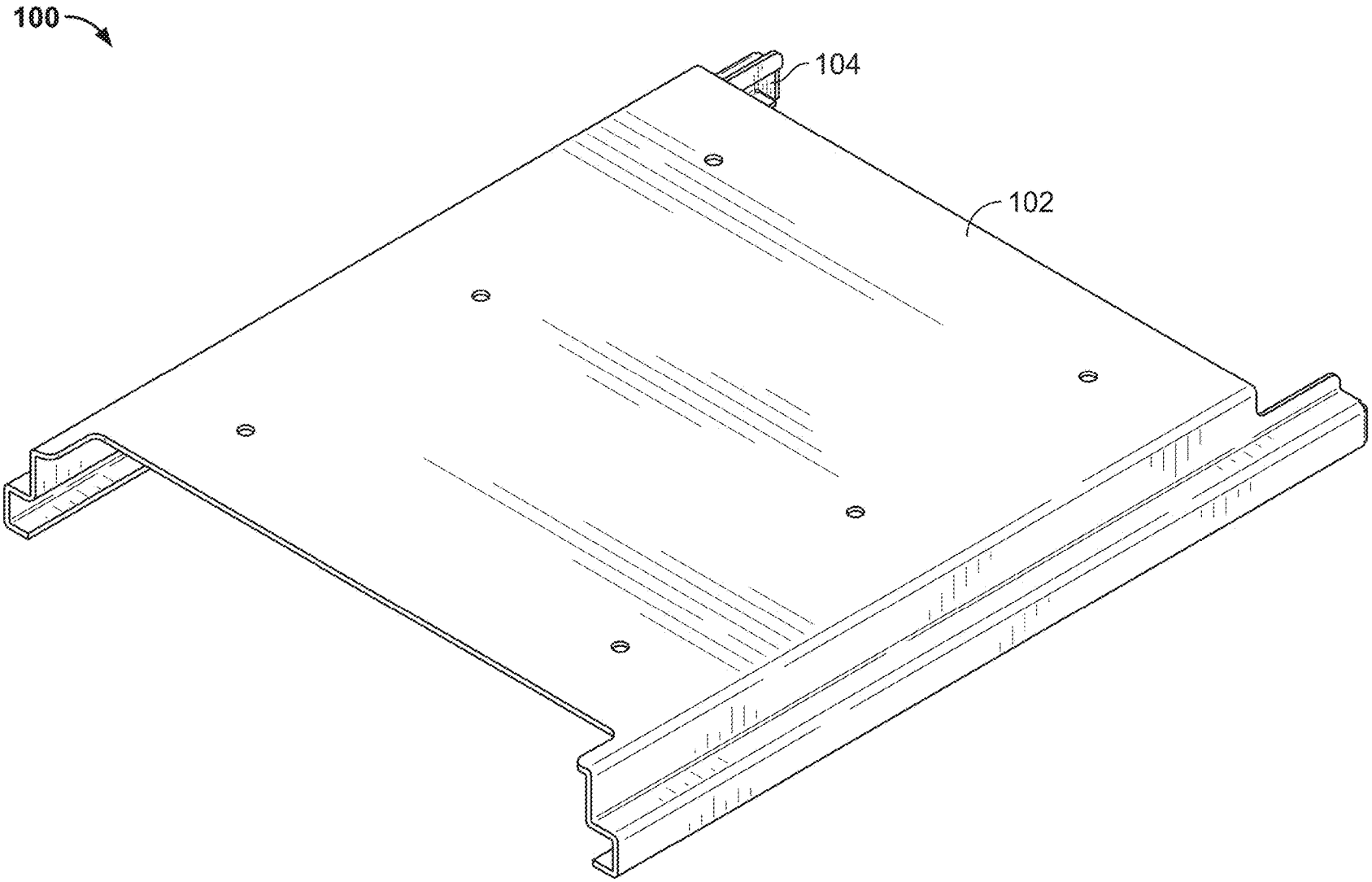
FIG. 1 is a front elevation view of the tote tray holder with c-shaped detents, an illustrative apparatus in accordance with principles of the disclosure.

FIG. 1 shows a front elevational view 100 of the tote tray holder 102 with c-shaped detents and fold tabs 104.

Figure 2:
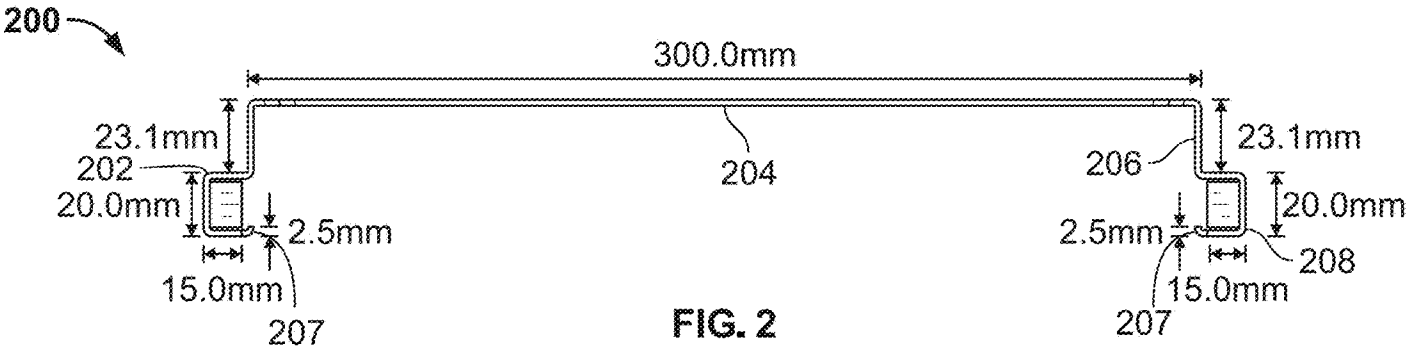
FIG. 2 is a rear side view of the tote tray holder with c-shaped detents, an illustrative apparatus in accordance with principles of the disclosure.

FIG. 2 shows a rear side view 200 of the tote tray holder 202 with c-shaped detents 208.

The tote tray holder 202 may include a metal frame. The metal frame may include a flat top portion 204. The metal frame may include two side portions. Each of the two side portions may include an elongated portion, 206. Each of the two side portions may include a c-shaped detent, 208. The flat top portion may be configured to be mounted to the bottom side of the tabletop. The two side portions may be configured to slidably engage respective edges of a tote tray.

The tote tray holder may have the following dimensions. A horizontal length from one edge of the flat top portion 204 to another edge of the flat top portion 204 may be about 300.0 mm. A vertical length from one edge of the elongated portion 206 to another edge of the elongated portion 206 of each of the two side portions may be about 23.1 mm. A vertical length from one edge of the c-shaped detent 208 to another edge of the c-shaped detent 208 of each of the two side portions may be about 20.0 mm. A horizontal length from one edge of the c-shaped detent 208 to another edge of the c-shaped detent 208 of each of the two side portions may be about 15.0 mm.

The c-shaped detent 208 of each of the two side portions of the tote tray holder may include a fold tab at the end of the c-shaped detent 208. The fold tab at the end of the c-shaped detent 208 may prevent the tote tray from unintentionally falling out of the tote tray holder. The fold tab may be located at the distal end of the tote tray holder with respect to a user.

The c-shaped detent 208 of each of the two side portions of the tote tray holder may include a stability ridge 207 on the edge of the c-shaped detent 208. Stability ridge 207 may have a maximum height of about 2.5 mm.

Figure 3:
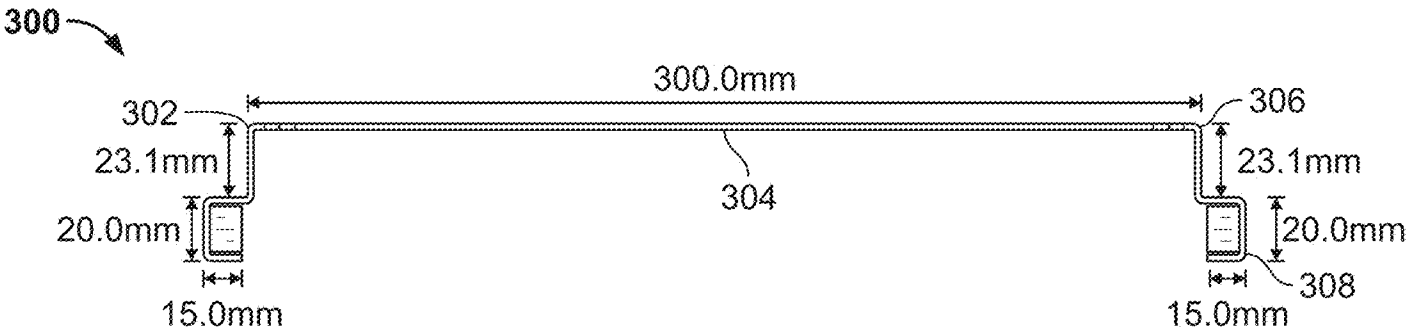
FIG. 3 is a front side view of the tote tray holder with c-shaped detents, an illustrative apparatus in accordance with principles of the disclosure.

FIG. 3 shows a front side view 300 of the tote tray holder 302 with c-shaped detents 308.

The tote tray holder 302 may include a metal frame. The metal frame may include a flat top portion 304. The metal frame may include two side portions. Each of the two side portions may include an elongated portion, 306. Each of the two side portions may include a c-shaped detent, 308. The flat top portion may be configured to be mounted using four or more screws or other device or devices. The flat top portion may be configured to be mounted to the bottom side of the tabletop. The two side portions may be configured to slidably engage respective edges of a tote tray. Such a tote tray may be formed from plastic, metal, or other suitable material.

The tote tray holder may have the following dimensions. A horizontal length from one edge of the flat top portion 304 to another edge of the flat top portion 304 may be about 300.0 mm. A vertical length from one edge of the elongated portion 306 to another edge of the elongated portion 306 of each of the two side portions may be about 23.1 mm. A vertical length from one edge of the c-shaped detent 308 to another edge of the c-shaped detent 308 of each of the two side portions may be about 20.0 mm. A horizontal length from one edge of the c-shaped detent 308 to another edge of the c-shaped detent 308 of each of the two side portions may be about 15.0 mm.

Figure 4:
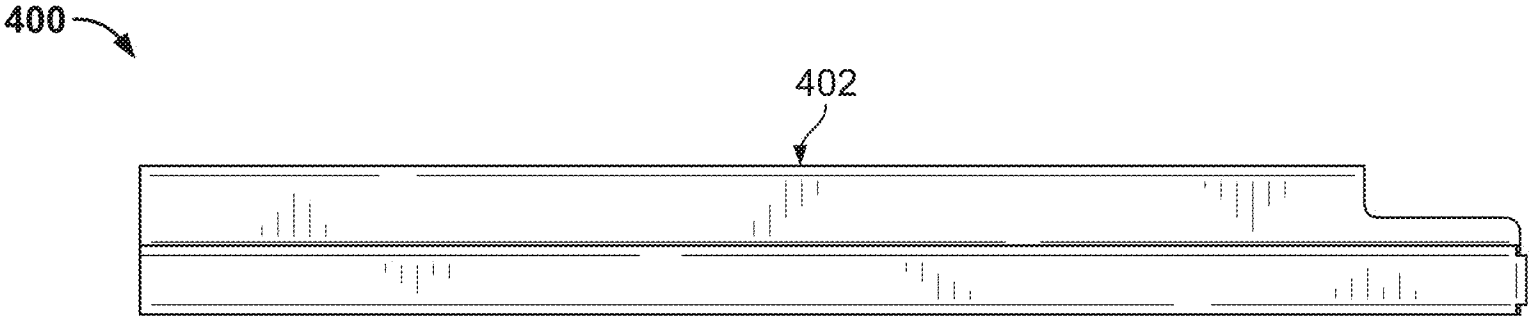
FIG. 4 is a right side view of the tote tray holder with c-shaped detents, an illustrative apparatus in accordance with principles of the disclosure.

FIG. 4 shows a right side view 400 of the tote tray holder 402 with c-shaped detents.

Figure 5:
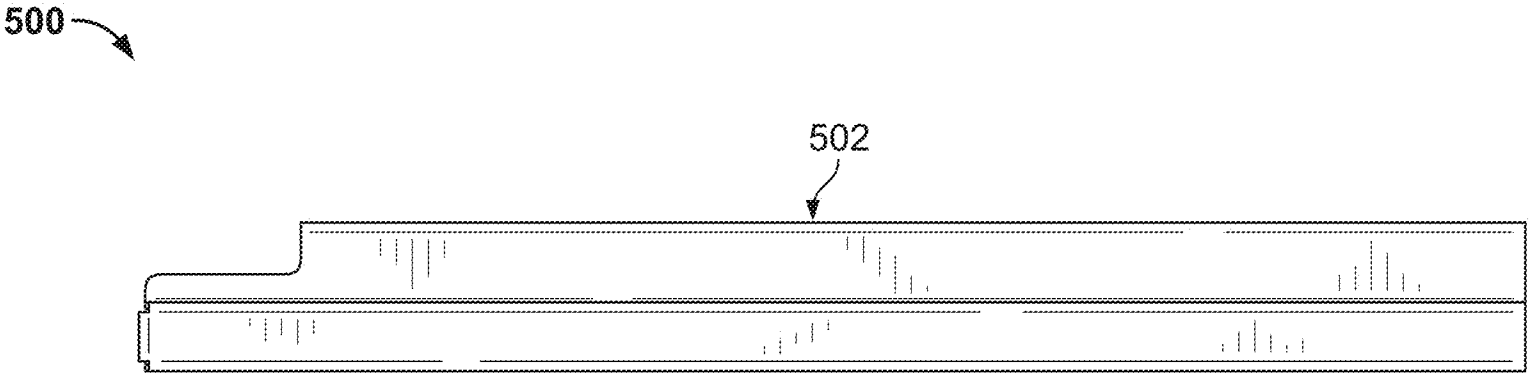
FIG. 5 is a left side view of the tote tray holder with c-shaped detents, an illustrative apparatus in accordance with principles of the disclosure.

FIG. 5 shows a left side view 500 of the tote tray holder 502 with c-shaped detents.

Figure 6:
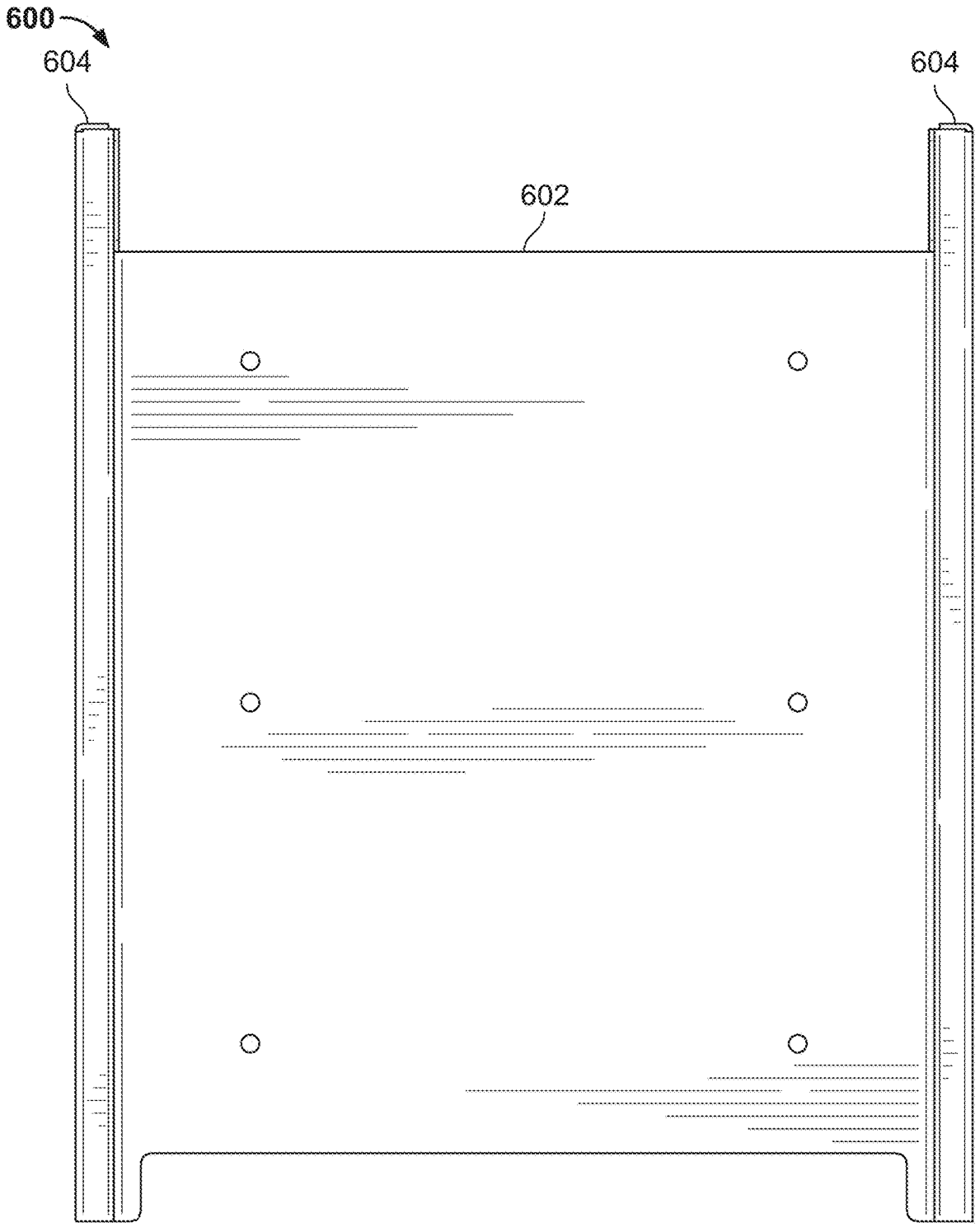
FIG. 6 is a top plan view of the tote tray holder with c-shaped detents, an illustrative apparatus in accordance with principles of the disclosure.

FIG. 6 shows a top plan view 600 of the tote tray holder 602 with c-shaped detents and fold tabs 604.

Figure 7:
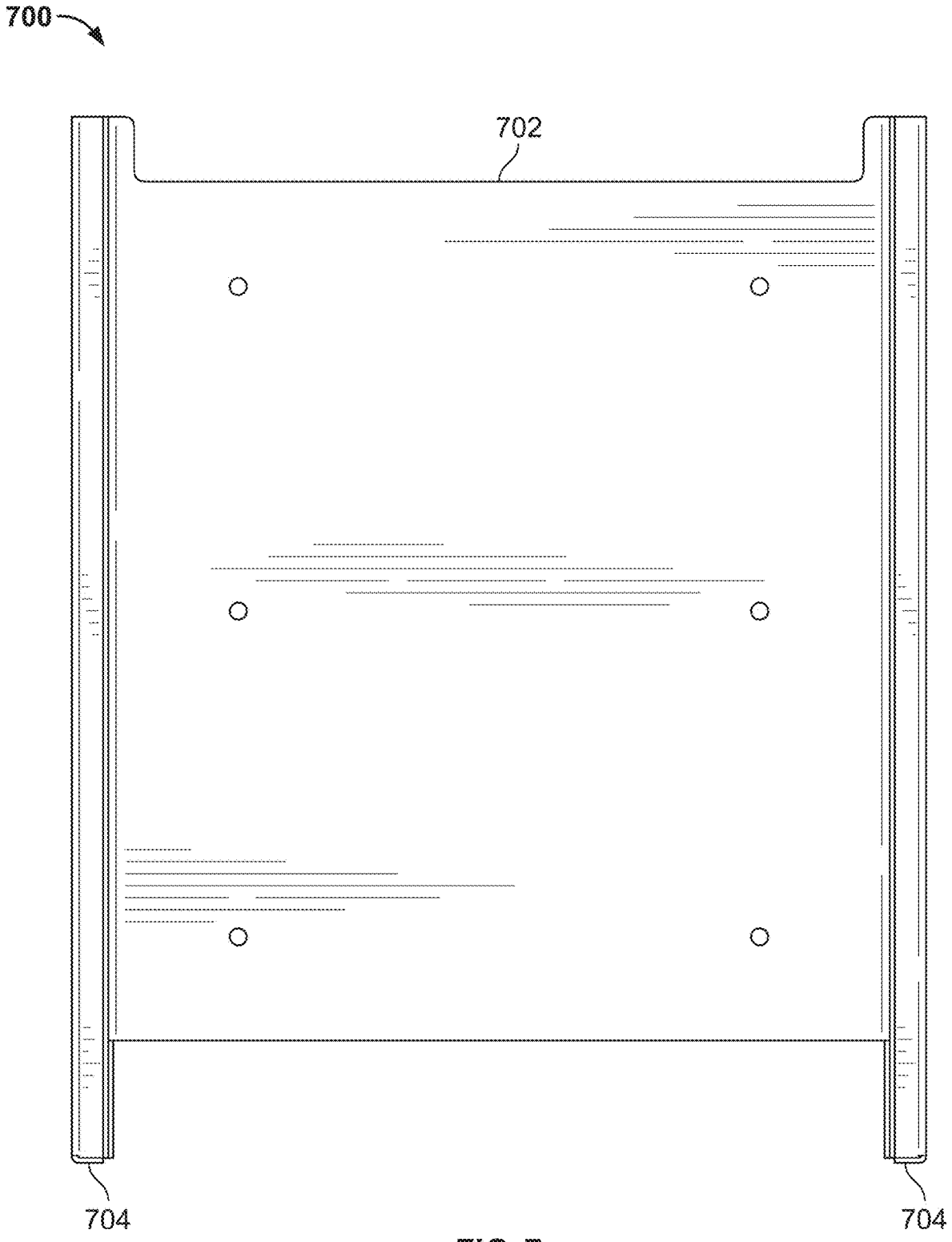
FIG. 7 is a bottom plan view of the tote tray holder with c-shaped detents, an illustrative apparatus in accordance with principles of the disclosure.

FIG. 7 shows a bottom plan view 700 of the tote tray holder 702 with c-shaped detents and fold tabs 704.

Figure 8:
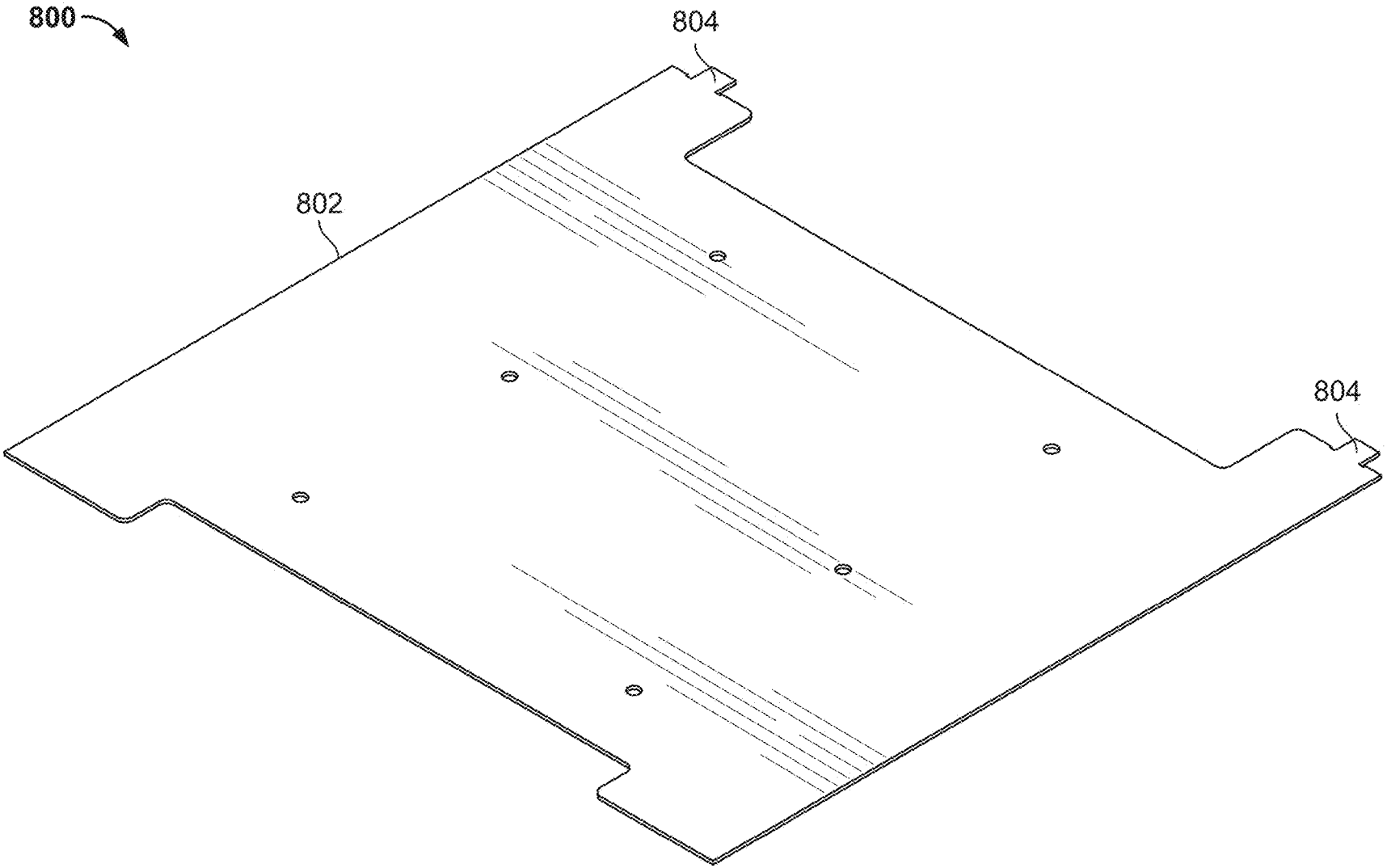
FIG. 8 is a front elevation view of the tote tray holder without c-shaped detents, an illustrative apparatus in accordance with principles of the disclosure.

FIG. 8 shows a front elevational view 800 of the tote tray holder 802 with fold tabs 804 and without c-shaped detents.

Figure 9:
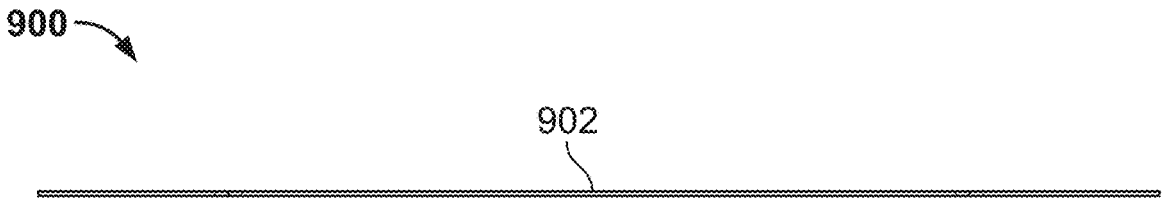
FIG. 9 is a rear side view of the tote tray holder without c-shaped detents, an illustrative apparatus in accordance with principles of the disclosure.

FIG. 9 shows a rear side view 900 of the tote tray holder 902 without c-shaped detents.

Figure 10:
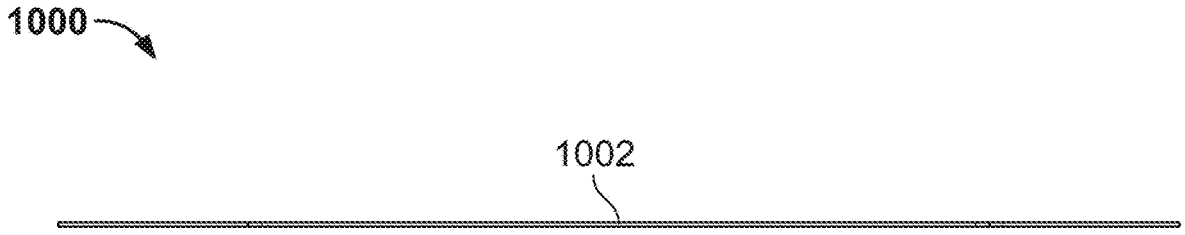
FIG. 10 is a front side view of the tote tray holder without c-shaped detents, an illustrative apparatus in accordance with principles of the disclosure.

FIG. 10 shows a front side view 1000 of the tote tray holder 1002 without c-shaped detents.

Figure 11:
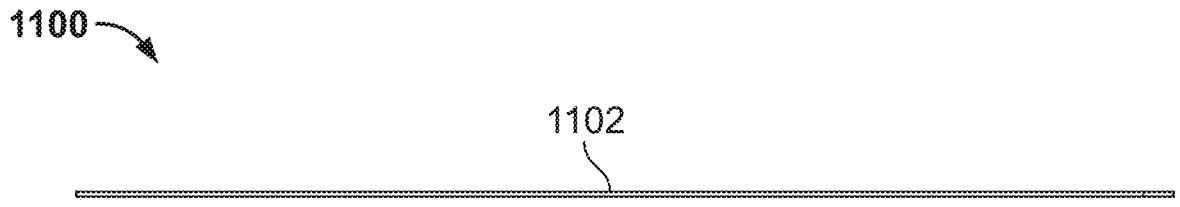
FIG. 11 is a right side view of the tote tray holder without c-shaped detents, an illustrative apparatus in accordance with principles of the disclosure.

FIG. 11 shows a right side view 1100 of the tote tray holder 1102 without c-shaped detents.

Figure 12:
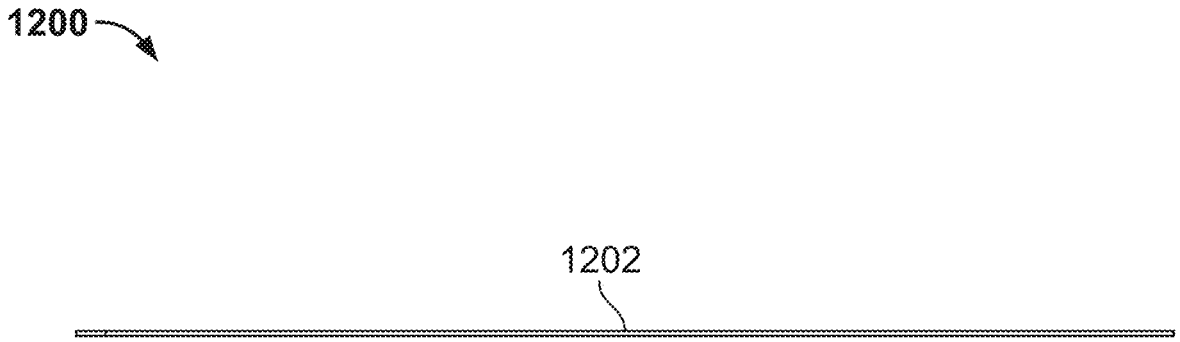
FIG. 12 is a left side view of the tote tray holder without c-shaped detents, an illustrative apparatus in accordance with principles of the disclosure.

FIG. 12 shows a left side view 1200 of the tote tray holder 1202 without c-shaped detents.

Figure 13:
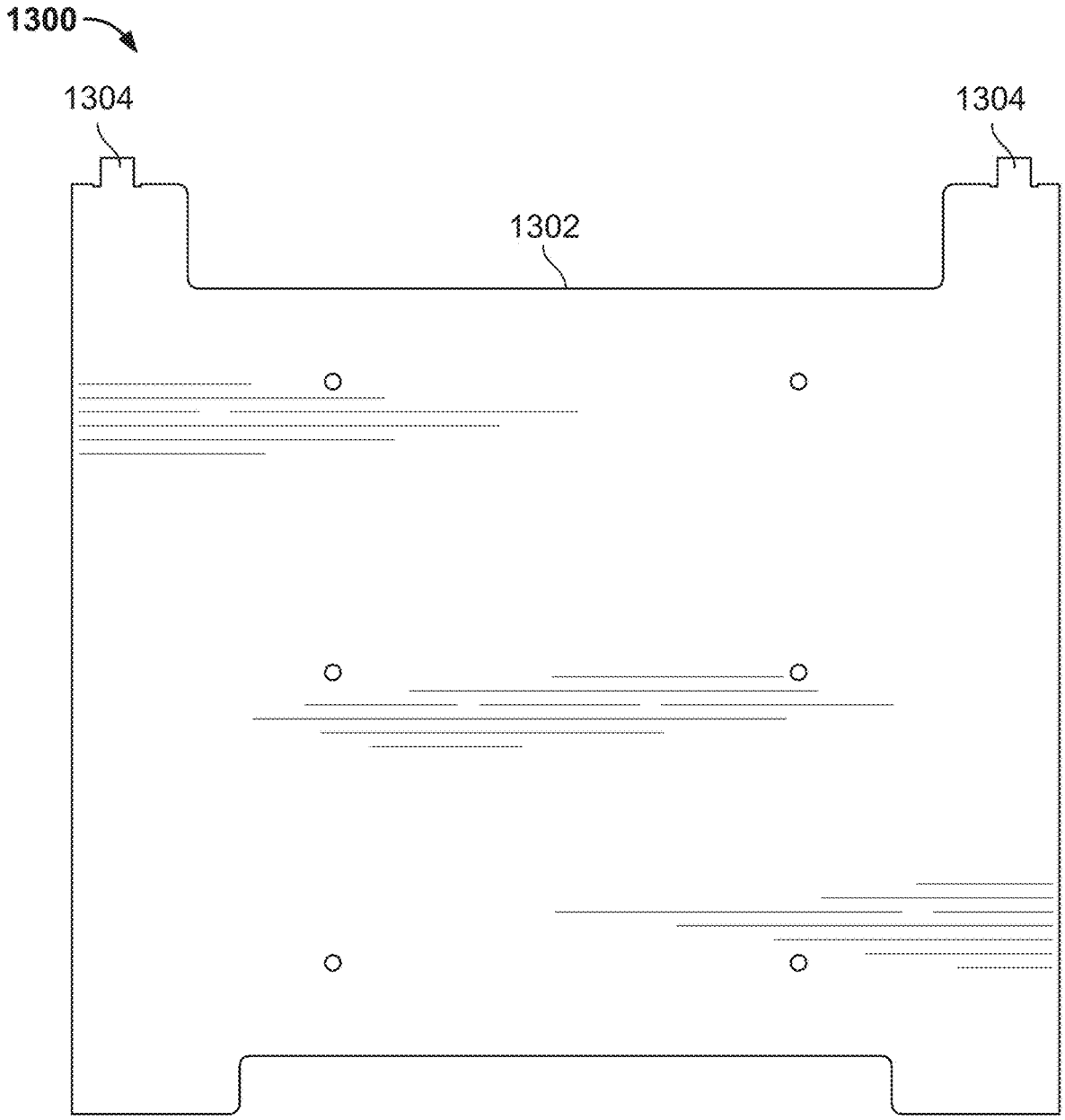
FIG. 13 is a top plan view of the tote tray holder without c-shaped detents, an illustrative apparatus in accordance with principles of the disclosure.

FIG. 13 shows a top plan view 1300 of the tote tray holder 1302 with fold tabs 1304 and without c-shaped detents.

Figure 14:
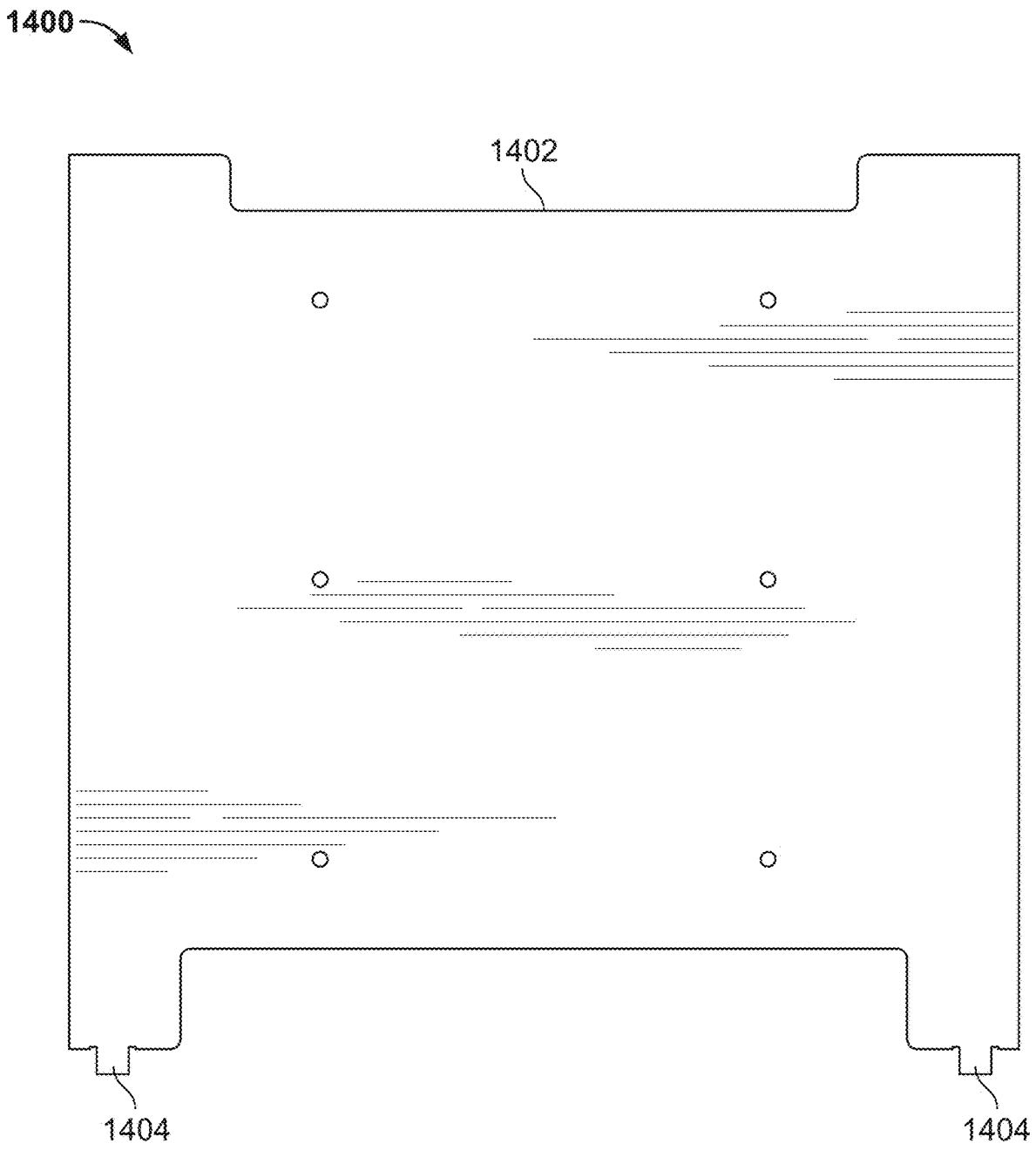
FIG. 14 is a bottom plan view of the tote tray holder without c-shaped detents, an illustrative apparatus in accordance with principles of the disclosure.

FIG. 14 shows a bottom plan view 1400 of the tote tray holder 1402 with fold tabs 1404 and without c-shaped detents.

Figure 15:
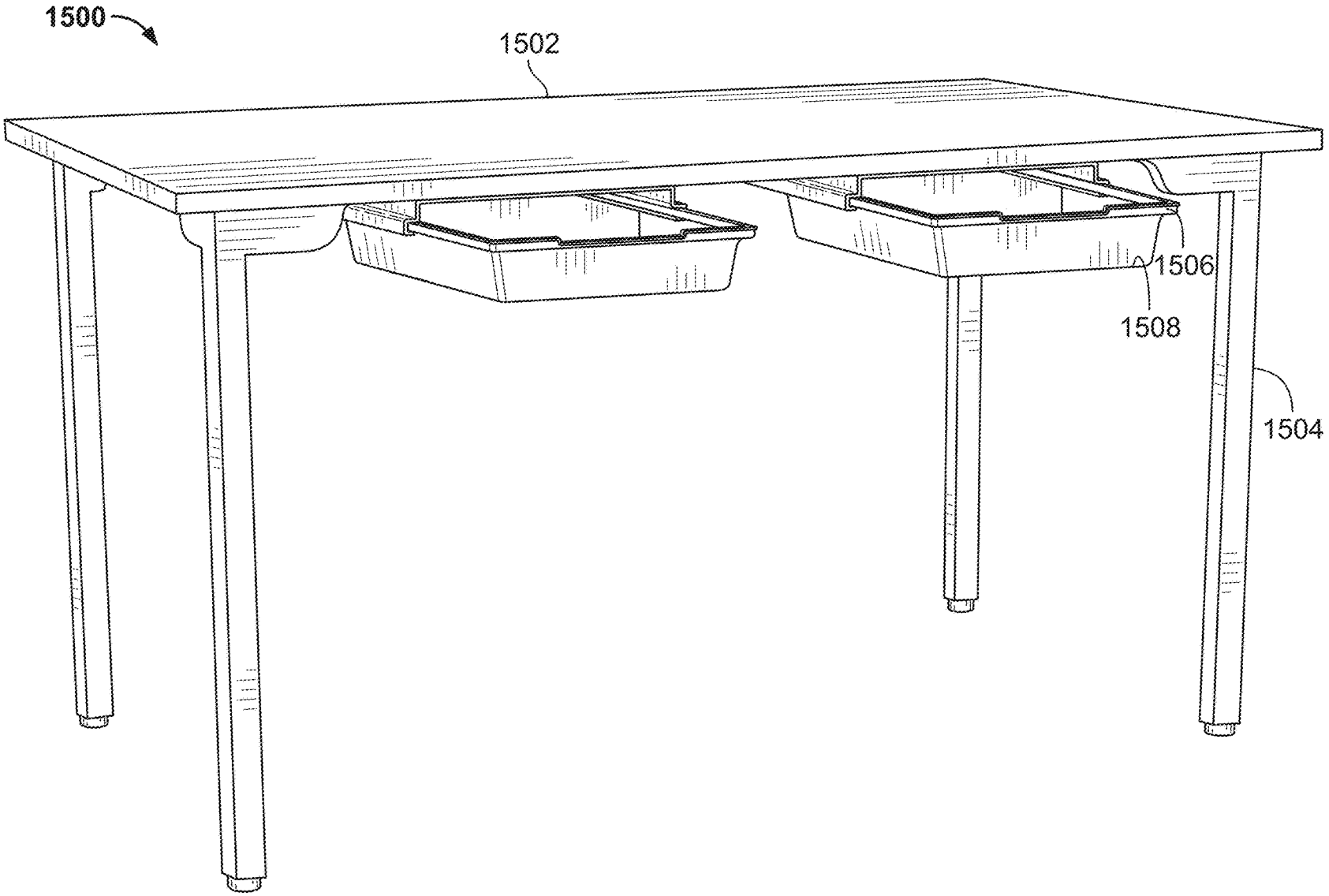
FIG. 15 is a front side view of a tote tray holder with c-shaped detents in a wheelchair-accessible heavy-duty table, an illustrative system in accordance with principles of the disclosure.

FIG. 15 shows a front side view 1500 of two tote tray holders 1506 with c-shaped detents in a wheelchair-accessible heavy-duty table 1502.

Wheelchair-accessible heavy-duty table 1502 may have a plurality of legs 1504. Tote trays 1508 may be slidably placed into the tote tray holders 1506.

Figure 16:
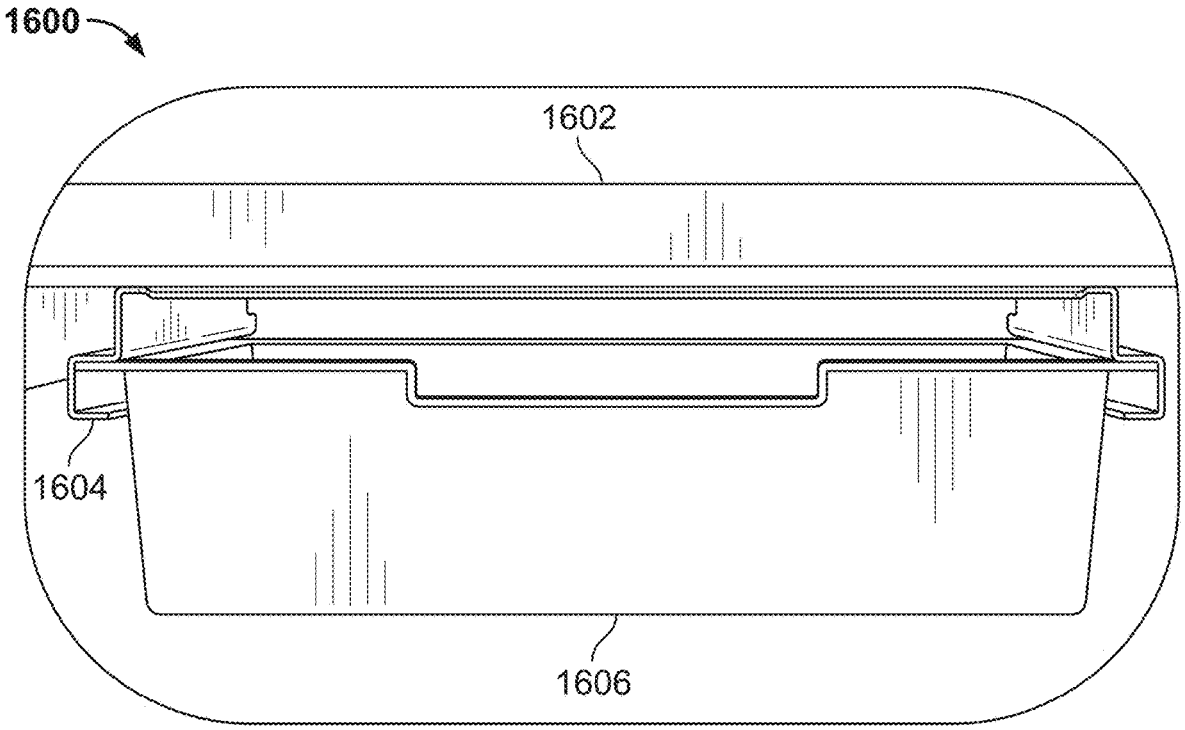
FIG. 16 is a front side view of the tote tray holder in the wheelchair-accessible heavy-duty table with c-shaped detents, an illustrative system in accordance with principles of the disclosure.

FIG. 16 shows a front side view 1600 of the tote tray holder 1604 with c-shaped detents in the wheelchair-accessible heavy-duty table 1602.

The tote tray holder 1604 may be mounted to the bottom of a tabletop of wheelchair-accessible heavy-duty table 1602. Tote tray 1606 may be slidably placed into the tote tray holder 1604.

Figure 17:
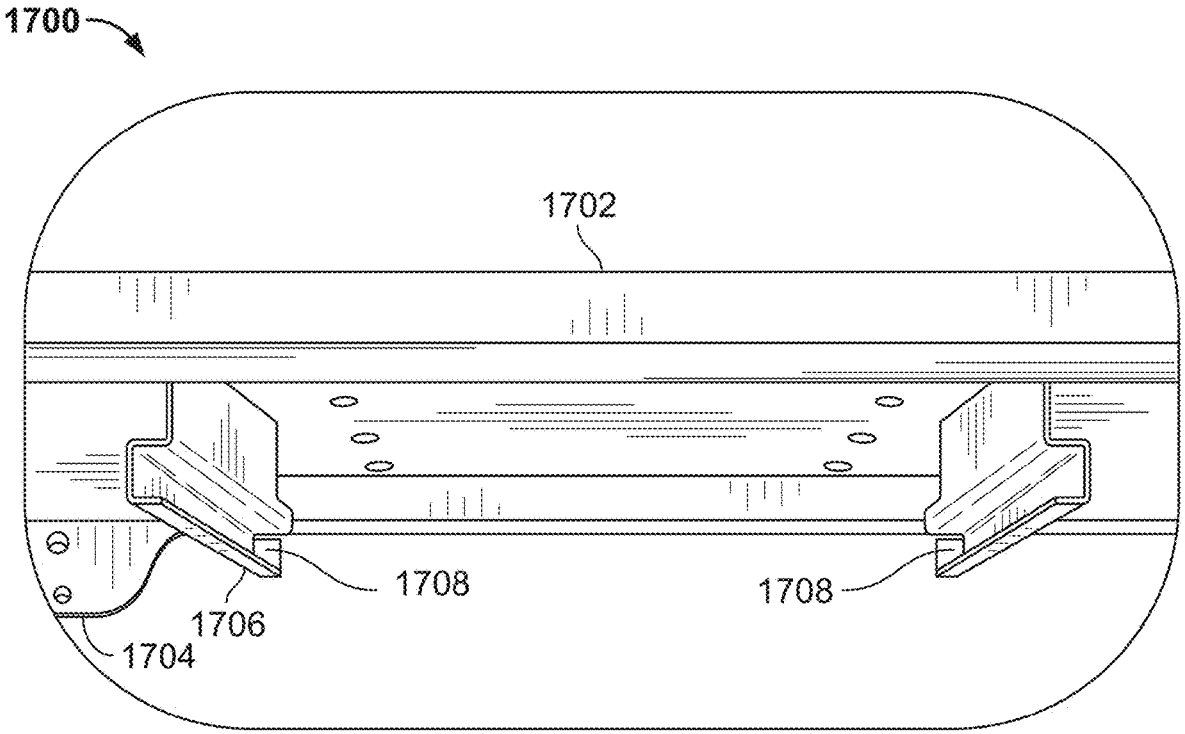
FIG. 17 is a bottom side view of the tote tray holder in the wheelchair-accessible heavy-duty table with c-shaped detents, an illustrative system in accordance with principles of the disclosure.

FIG. 17 shows a bottom side view 1700 of the tote tray holder 1706 with c-shaped detents in the wheelchair-accessible heavy-duty table 1702.

The tote tray holder 1706 may be mounted to the bottom of a tabletop of wheelchair-accessible heavy-duty table 1702. Apron 1704 may support the wheelchair-accessible heavy-duty table 1702. Fold tab 1708 may be located at the end of the c-shaped detent. Fold tab 1708 may prevent the tote tray from unintentionally falling out of the tote tray holder.

Figure 18:
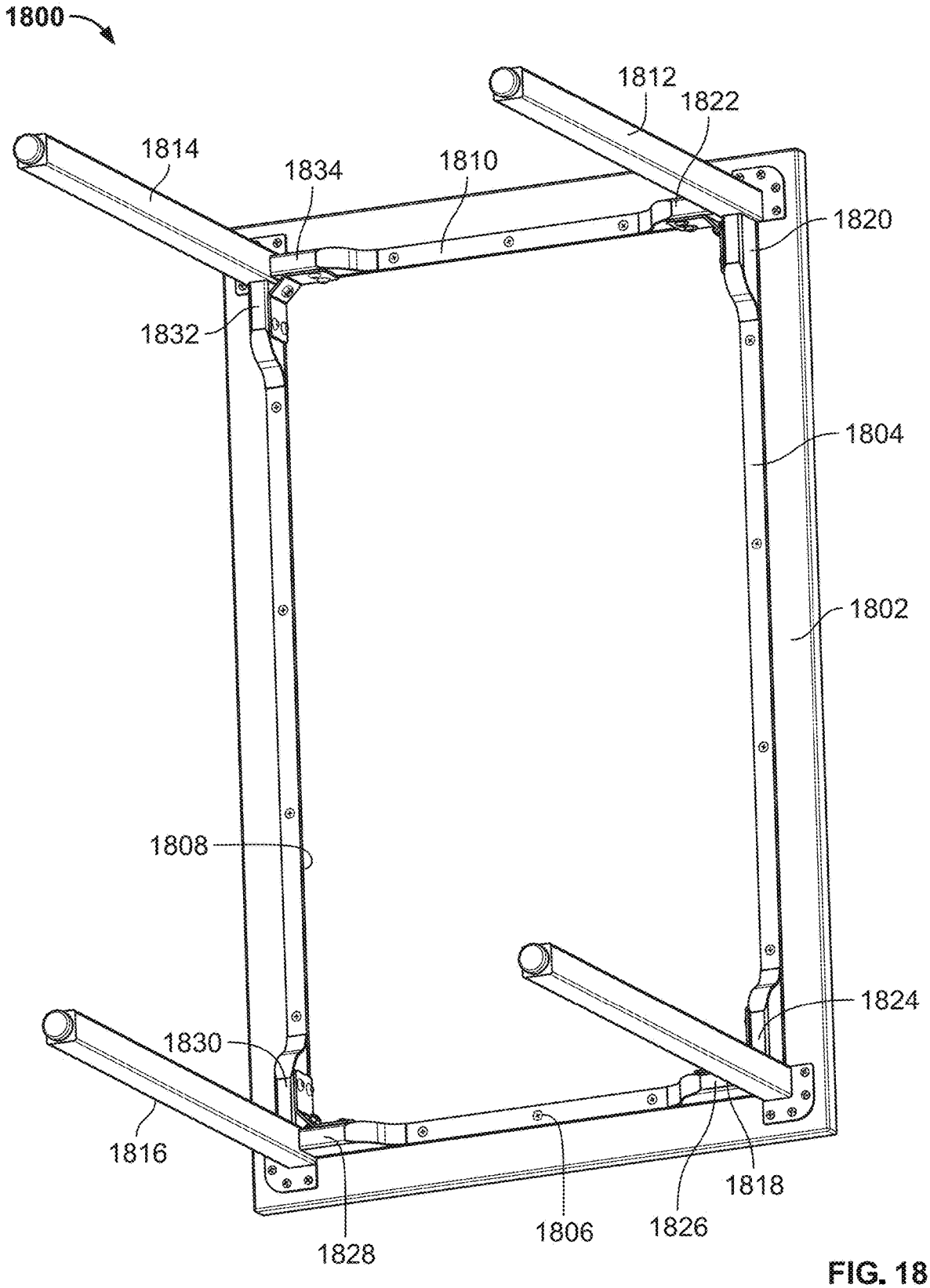
FIG. 18 is a bottom side view of the wheelchair-accessible heavy-duty table, an illustrative system in accordance with principles of the disclosure.

FIG. 18 shows a bottom side view 1800 of the wheelchair-accessible heavy-duty table 1802. Heavy-duty table 1802 may have one or more feature in common with heavy-duty table 1702.

Heavy-duty table 1802 may include tabletop 1808. Tabletop 1808 may include a tabletop bottom. Table legs 1812, 1814, 1816 and 1818 may be mounted to the tabletop bottom. Table legs 1812, 1814, 1816 and 1818 may be mounted to the tabletop bottom using mounting brackets (e.g., 1810). Table legs 1812, 1814, 1816 and 1818 may be mounted to the tabletop bottom by screwing (e.g., with screw 1806) mounting brackets into the tabletop bottom.

Heavy-duty table 1802 may include aprons 1820, 1822, 1824, 1826, 1828, 1830, 1832, and 1834. Aprons 1820, 1824, 1830, and 1832 may have a first length. Aprons 1822, 1826, 1828, and 1834 may have a second length.

Figure 19:
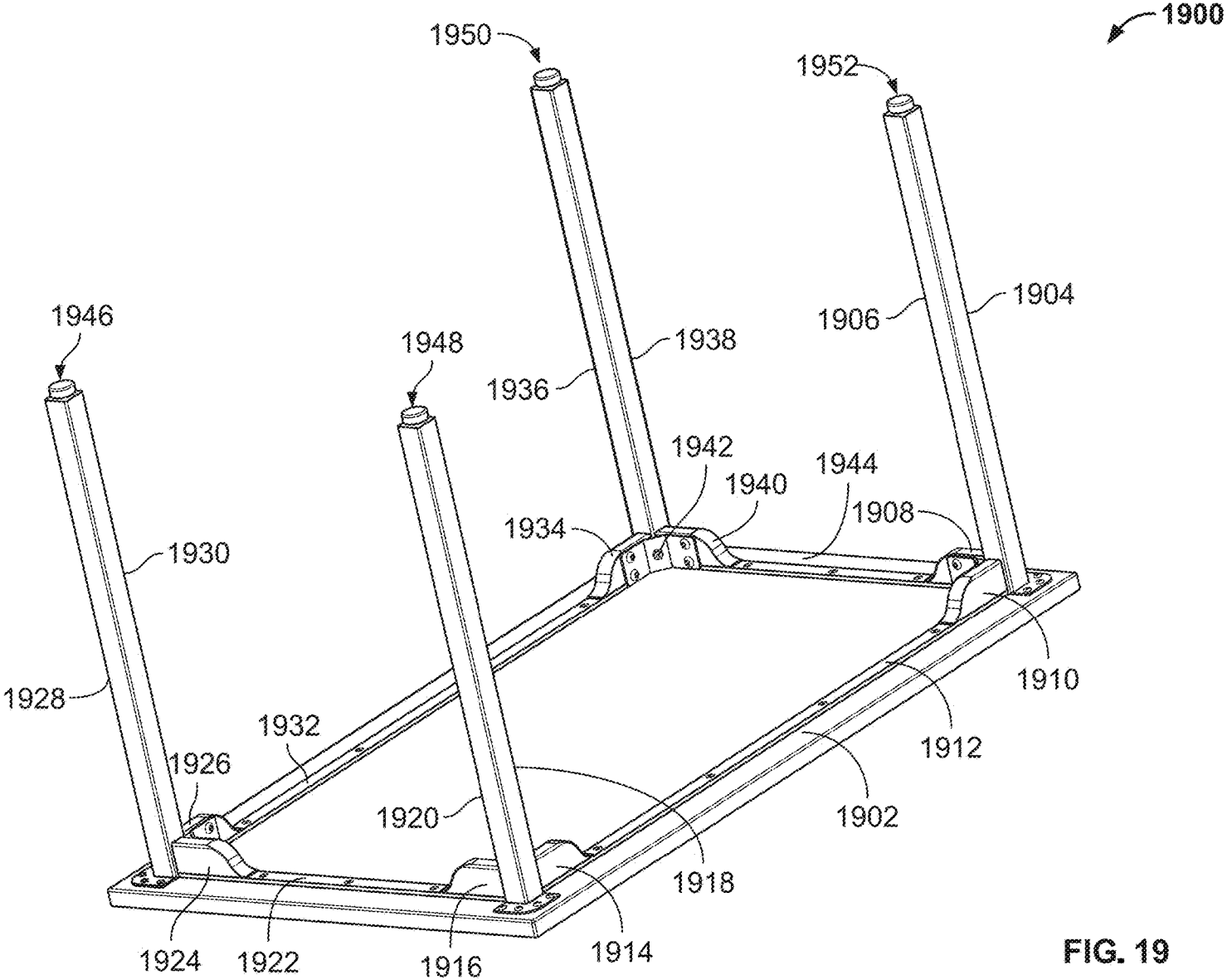
FIG. 19 is yet another bottom side view of the wheelchair-accessible heavy-duty table, an illustrative system in accordance with principles of the disclosure.

FIG. 19 shows yet another bottom side view 1900 of the wheelchair-accessible heavy-duty table 1902. Heavy-duty table 1902 may have one or more feature in common with heavy-duty table 1802.

Heavy-duty table 1902 may include a tabletop. The tabletop may include a tabletop bottom. Table legs 1946, 1948, 1950, and 1952 may be mounted to the tabletop bottom. Table legs 1946, 1948, 1950, and 1952 may be mounted to the tabletop bottom using mounting brackets (e.g., 1912, 1922, 1932, and 1944). Table legs 1946, 1948, 1950, and 1952 may be mounted to the tabletop bottom by screwing (e.g., with screw 1942) mounting brackets into the tabletop bottom.

Table legs 1946, 1948, 1950, and 1952 may each have a front side and a back side (e.g., 1904, 1906, 1918, 1920, 1928, 1930, 1936, and 1938). Table legs 1946, 1948, 1950, and 1952 may each have a cylindrical stopper on the bottom of each table leg.

Heavy-duty table 1902 may include aprons 1908, 1910, 1914, 1916, 1924, 1926, 1934, and 1940. Aprons 1908, 1916, 1924, and 1940 may have a first length. Aprons 1910, 1914, 1926, and 1934 may have a second length.

Figure 20:
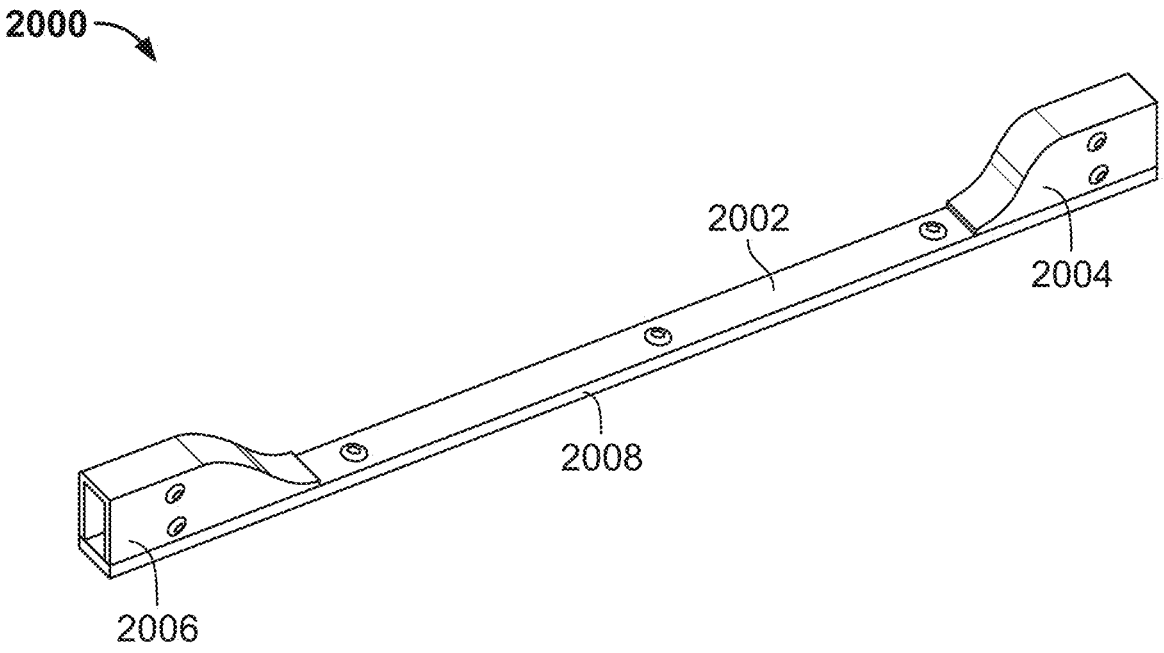
FIG. 20 is a top side view of two aprons from a wheelchair-accessible heavy-duty table, an illustrative system in accordance with principles of the disclosure.

FIG. 20 shows an illustrative top side view of apron 2000 from a wheelchair-accessible heavy-duty table. Apron 2000 may have one or more features in common with one or more of the aprons as described in one or more of heavy-duty table 1902 and heavy-duty table 1802.

Apron 2000 may include apron support 2002. Apron 2000 may include apron ends 2006 and 2004. Apron ends 2006 and 2004 may be welded to apron support 2002. Apron support 2002 may include tapped holes. Tapped holes may be configured to accept screws. Apron 2000 may be mounted to a tabletop bottom by screwing screws through tapped holes into the tabletop bottom. Apron ends 2004 and 2006 may be disposed in between two table legs.

Figure 21:
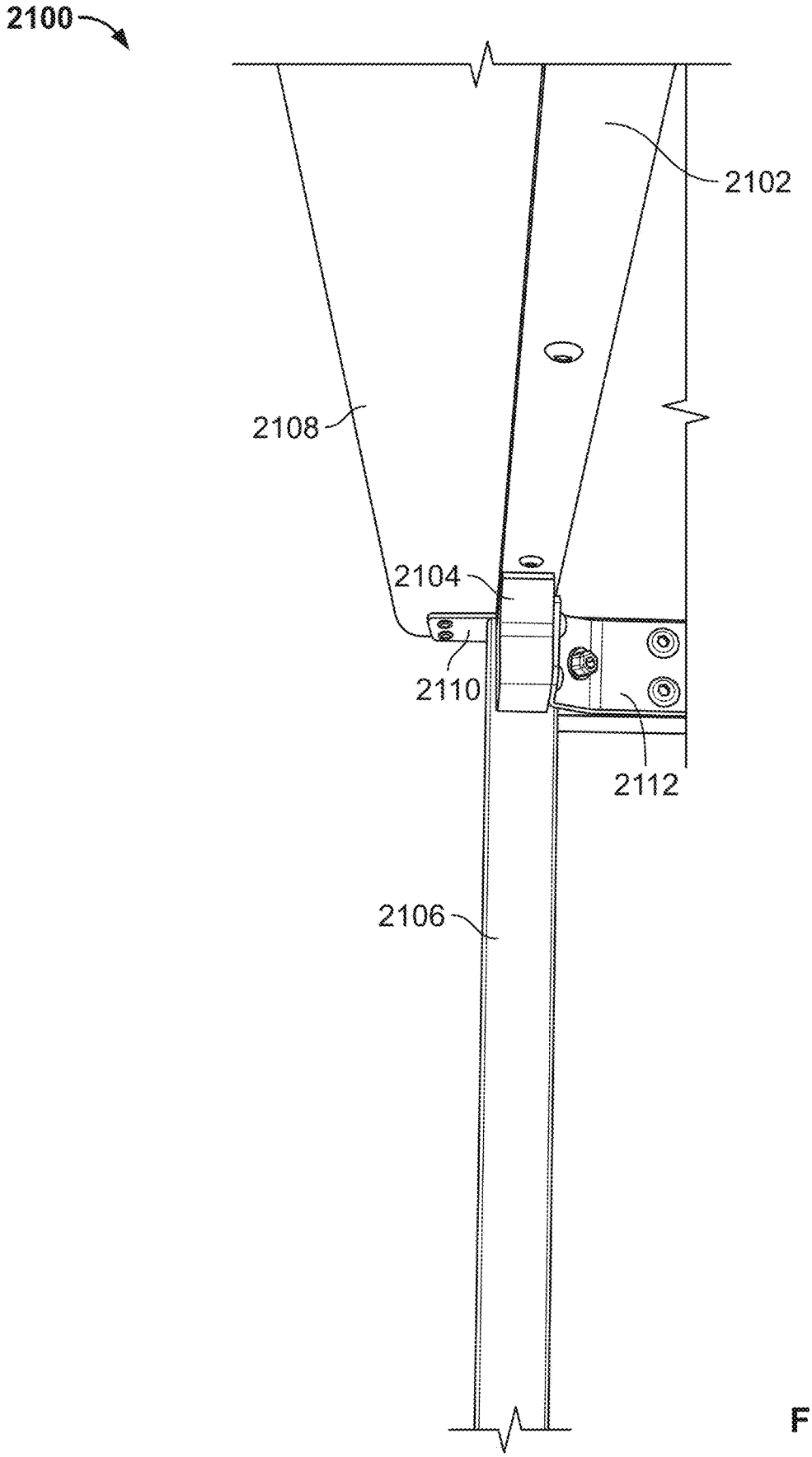
FIG. 21 is a side view of an apron connecting a wheelchair-accessible heavy-duty table, an illustrative system in accordance with principles of the disclosure.

FIG. 21 is a side view of an apron connecting a wheelchair-accessible heavy-duty table.

FIG. 21 shows illustrative bottom view of heavy-duty table 2100. Heavy-duty table 2100 may have one or more features in common with one or more of heavy-duty tables 1802 and 1902.

Apron support 2102 may be mounted to tabletop bottom 2108. Apron support 2102 may be mounted to tabletop bottom 2108 using screws. Apron end 2104 may be welded to apron support 2102. Apron end 2104 may be disposed adjacent inner side 2106 of table leg 2106. Table leg 2106 may be mounted to tabletop bottom 2108 via mounting bracket 2110. Corner bracket 2112 may be affixed to apron end 2104 table leg 2106, and an apron end of a second apron support (not shown). Corner bracket 2112 may be affixable to apron end 2104 and the apron end of the second apron end via mounting screws. Corner bracket 2112 may be affixable to table leg 2106 via mounting screw $S_3$.

Figure 22:
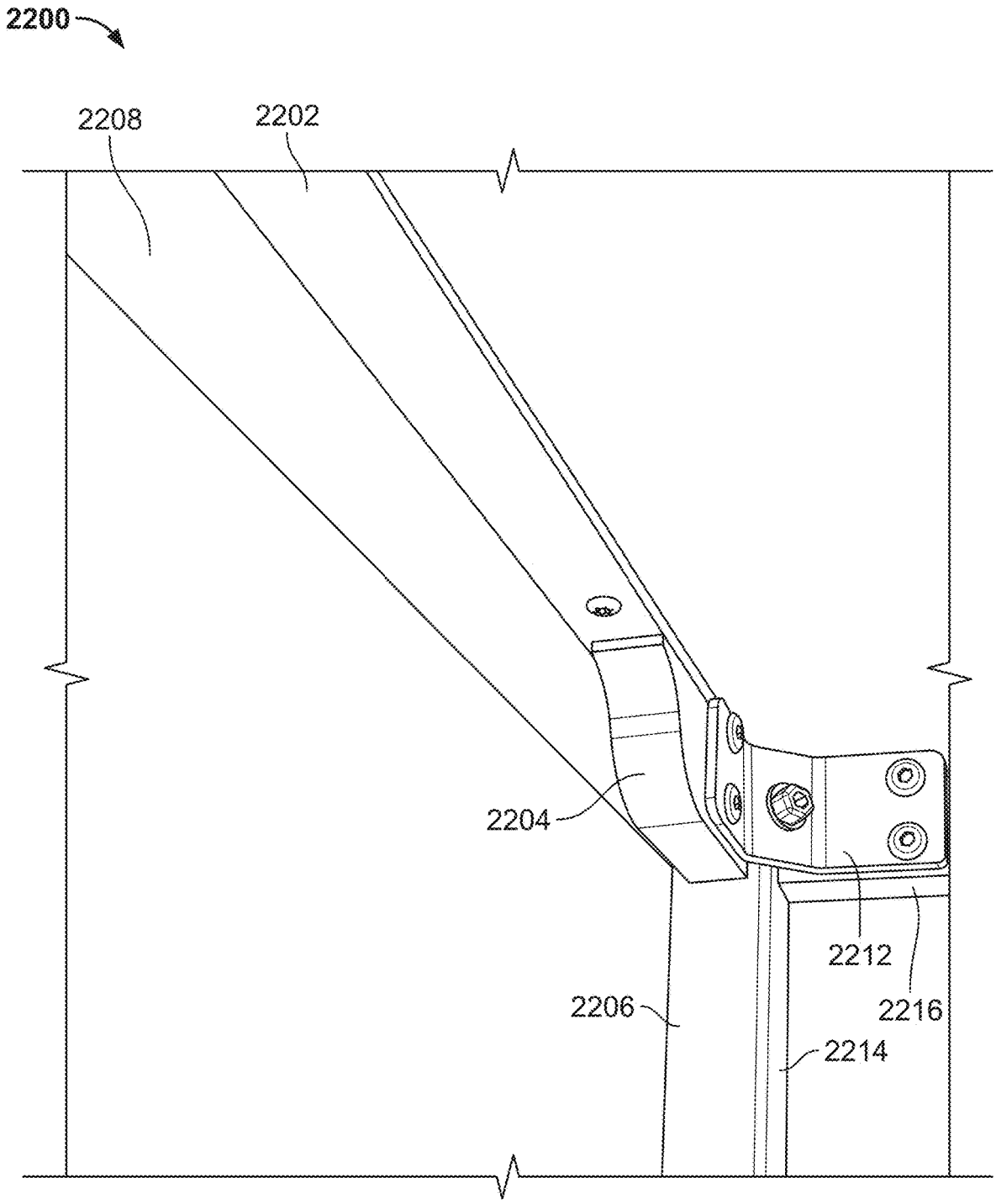
FIG. 22 is a bottom view of an apron connecting a wheelchair-accessible heavy-duty table, an illustrative system in accordance with principles of the disclosure.

FIG. 22 shows another bottom view of heavy-duty table 2200. The second apron may include apron end 2216. Apron end 2216 may be disposed adjacent inner side 2214 of table leg 2206. Inner sides 2206 and 2214 may intersect. Corner bracket 2212 may connect apron end 2204, table leg 2206 and apron end 2216. Corner bracket 2212 may provide an additional level of support to heavy-duty table 2200.

Figure 23:
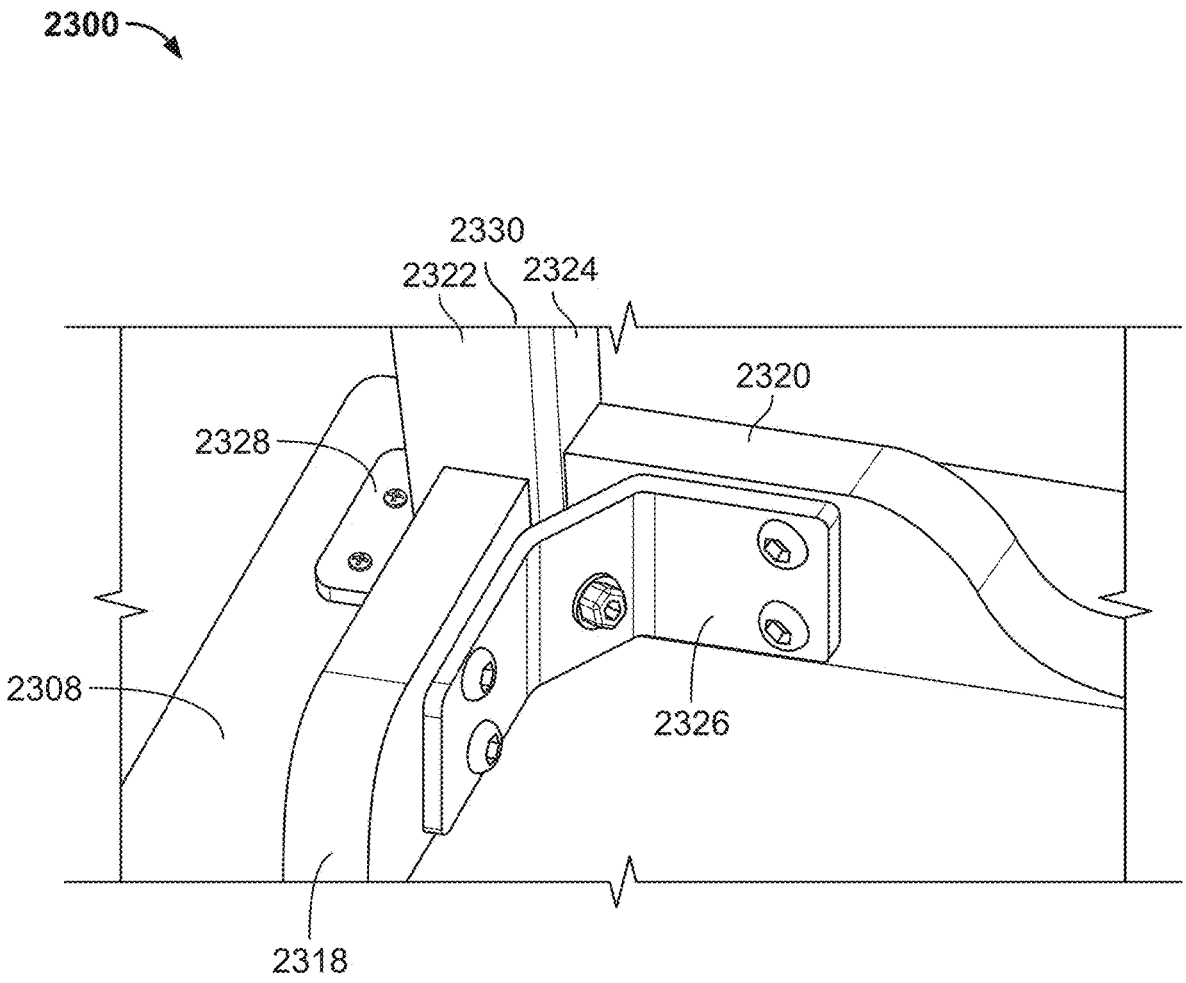
FIG. 23 is a side view of two aprons mounted to a wheelchair-accessible heavy-duty table, an illustrative system in accordance with principles of the disclosure.

FIG. 23 is a side view of two aprons mounted to a wheelchair-accessible heavy-duty table.

FIG. 23 shows another view of heavy-duty table 2300. Apron end 2318 may be disposed adjacent inner side 2322 of table leg 2330. Table leg 2330 may be mounted to tabletop bottom 2308 via mounting bracket 2328. Apron end 2320 may be disposed adjacent inner side 2324 of table leg 2330. Inner sides 2322 and 2324 may intersect. Corner bracket 2326 may be affixed to apron end 2318 table leg 2330, and apron end 2320. Corner bracket 2326 may be affixable to apron end 2318 and apron end 2320 via mounting screws. Corner bracket 2326 may be affixable to table leg 2330 via mounting screws. Corner bracket 2326 may provide an additional level of support to heavy-duty table 2300.

Figure 24:
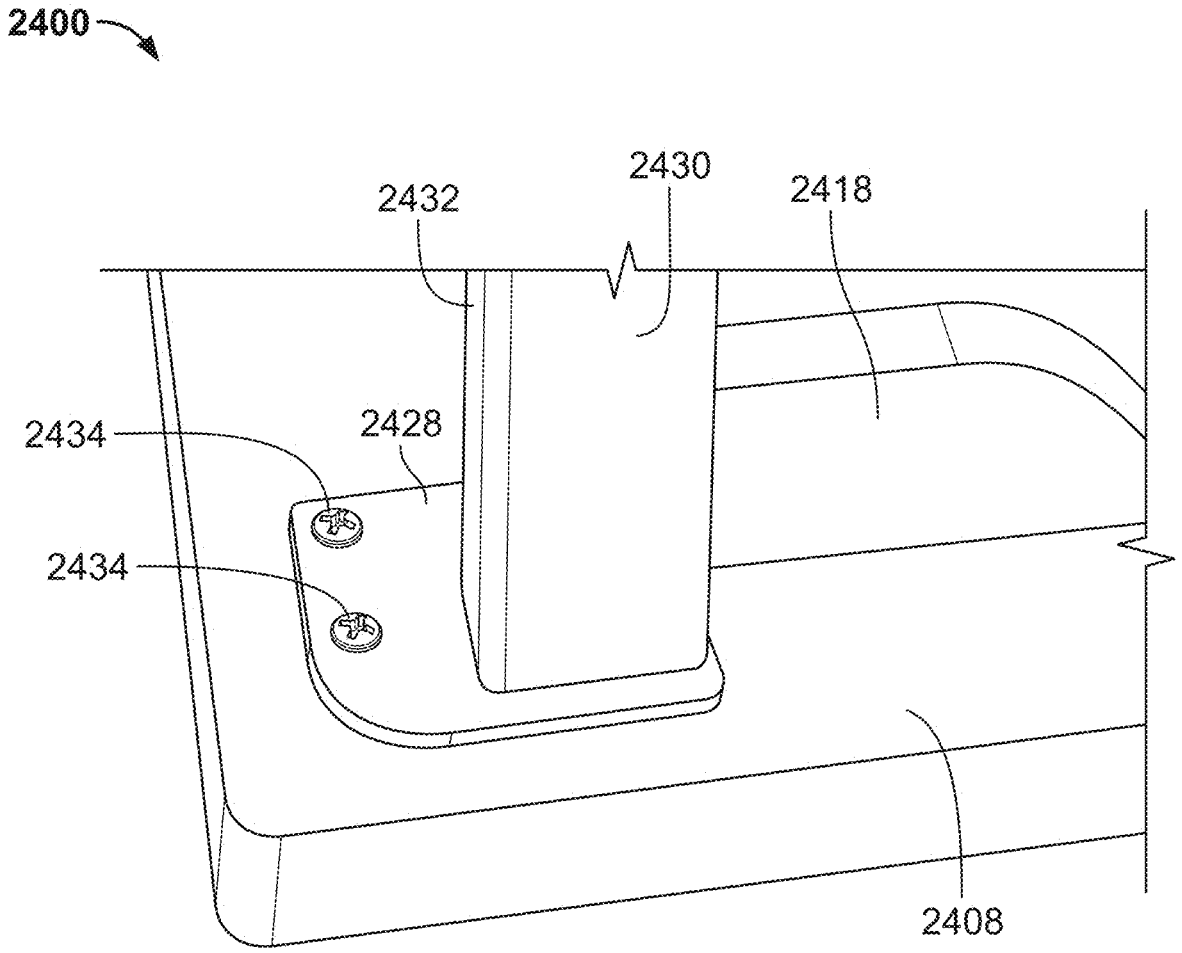
FIG. 24 is a bottom side view of an apron mounted to a wheelchair-accessible heavy-duty table, an illustrative system in accordance with principles of the disclosure.

FIG. 24 shows another view of heavy-duty table 2400 and apron 2418. A table leg may include outer sides 2430 and 2432. Outer sides 2430 and 2432 may intersect. Outer sides 2430 and 2432 may intersect with inner sides (as shown in FIG. 23). Table leg may be mounted to tabletop bottom 2408 by screwing mounting bracket 2428 into tabletop bottom 2408 using mounting screws 2434.

Figure 25:
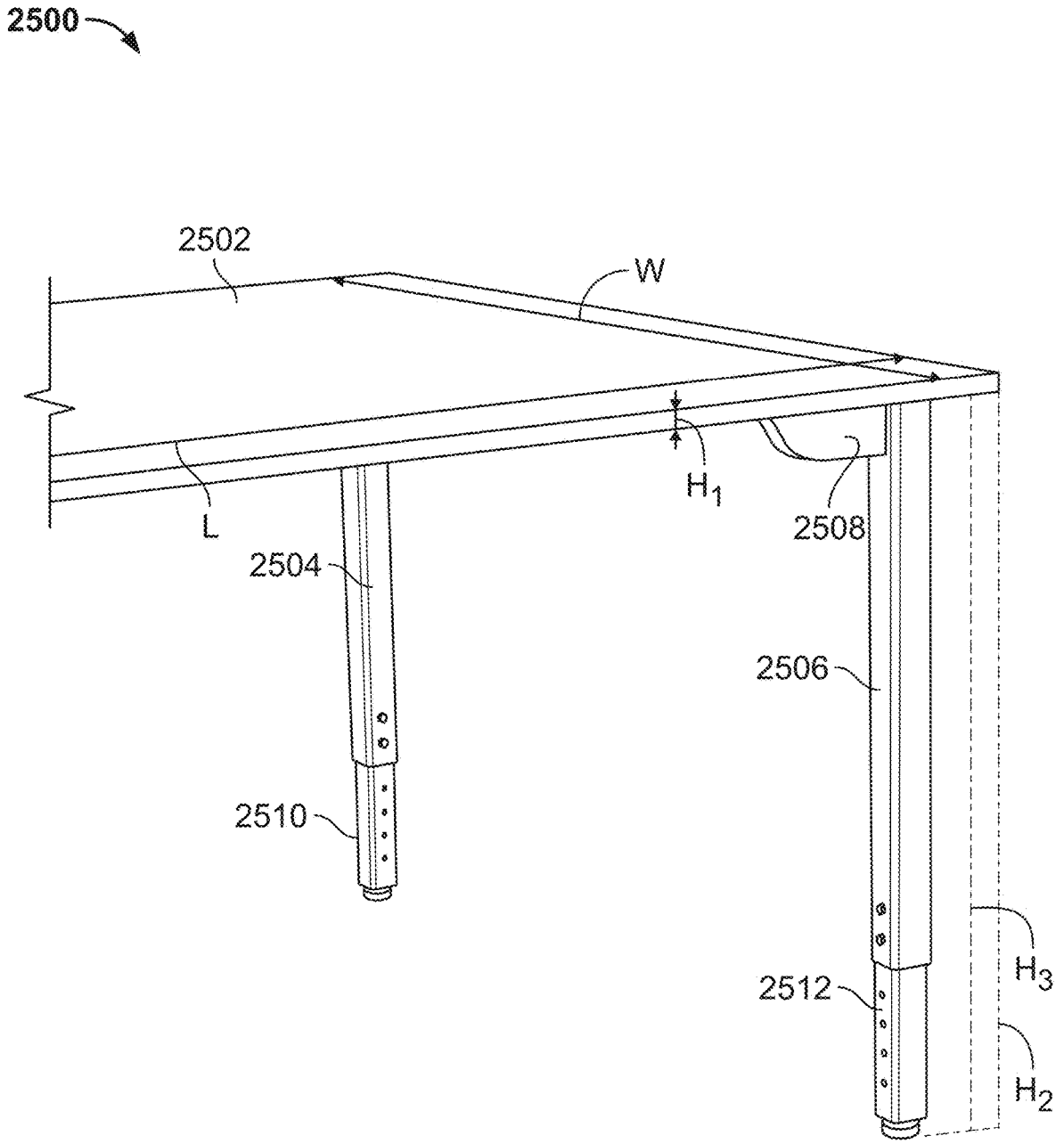
FIG. 25 is a side view of a wheelchair-accessible heavy-duty table, an illustrative system in accordance with principles of the disclosure.

FIG. 25 shows an illustrative view of heavy-duty table 2500. Heavy-duty table 2500 may have one or more feature in common with one or more of heavy-duty tables 1802 and 1902.

Heavy-duty table 2500 may include tabletop 2502. Tabletop 2502 may have a length L. Length L may be any suitable length listed in table 2 (below). Tabletop 2502 may have a width W. Width W may be any suitable width listed in table 3 (below). Tabletop 2502 may include a height $H_1$. Height $H_1$ may be any suitable height of a tabletop. Length L, width W, and height $H_1$ may vary. Length L, width W, and height $H_1$ may be customizable.

Heavy-duty table 2500 may include table legs 2504 and 2506. Table legs 2504 and 2506 may be adjustable legs. Table leg 2504 may include adjustable segment 2510. Table leg 2506 may include adjustable segment 2512. Table legs 2504 and 2506 may be adjustable by adjusting adjustable segment 2510 and 2512. $H_3$, the height of table legs 2504 and 2506 in addition to $H_1$ may define the height, $H_2$, of heavy-duty table 2500. Height $H_2$ may be any height included in the range of heights listed in table 4 (below).

Figure 26:
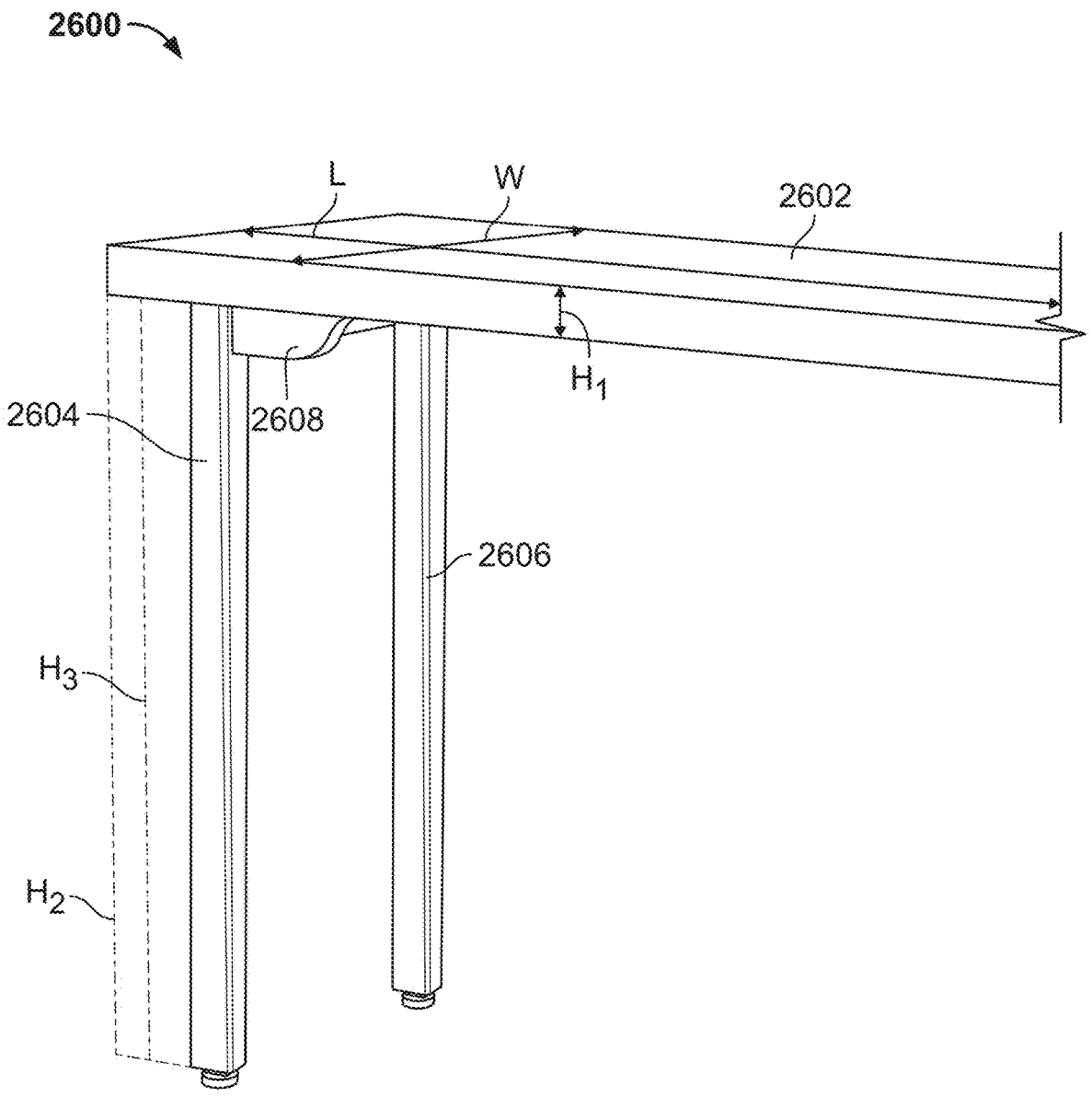
FIG. 26 is a side view of a wheelchair-accessible heavy-duty table, an illustrative system in accordance with principles of the disclosure.

FIG. 26 shows an illustrative view of heavy-duty table 1200. Heavy-duty table 2600 may have one or more feature in common with one or more of heavy-duty tables 1802 and 1902.

Heavy-duty table 2600 may include tabletop 2602. Tabletop 2602 may have a length L. Length L may be any suitable length listed in table 2 (below). Tabletop 2602 may have a width W. Width W may be any suitable width listed in table 3 (below). Tabletop 2602 may include a height $H_1$. Height $H_1$ may be any suitable height of a tabletop. Length L, width W, and height $H_1$ may vary. Length L, width W, and height $H_1$ may be customizable.

Heavy-duty table 2600 may include table legs 2604 and 2606. Table legs 2604 and 2606 may be fixed height legs. $H_3$, the height of table legs 2604 and 2606 in addition to $H_1$ may define the height, $H_2$, of heavy-duty table 2600. Height $H_2$ may be any height included in the range of heights listed in table 5 (below).

Figure 27:
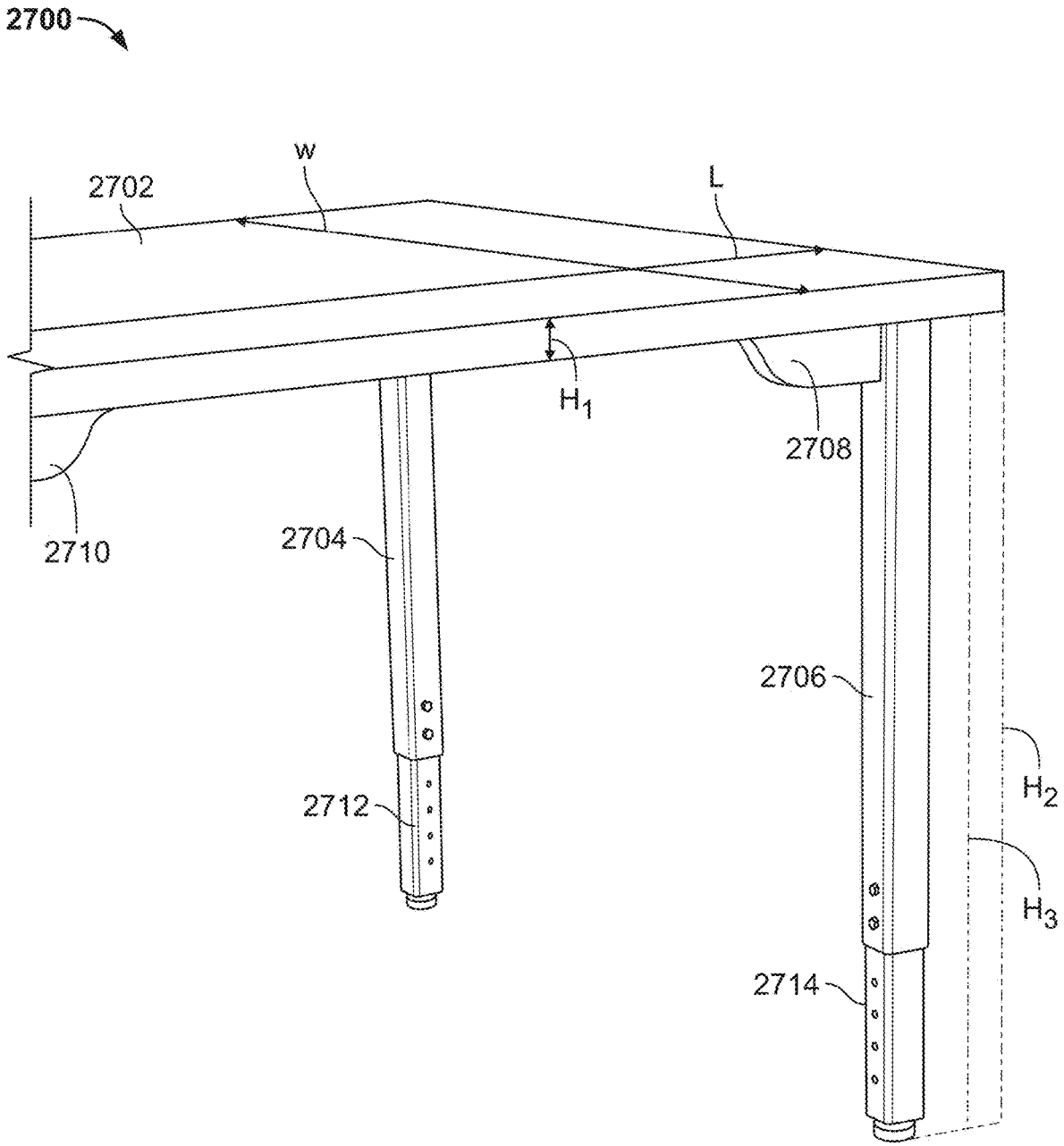
FIG. 27 is a side view of a wheelchair-accessible heavy-duty table, an illustrative system in accordance with principles of the disclosure.

FIG. 27 shows an illustrative view of heavy-duty table 2700. Heavy-duty table 2700 may have one or more feature in common with one or more of heavy-duty tables 1802 and 1902.

Heavy-duty table 2700 may include tabletop 2702. Tabletop 2702 may have a length L. Length L may be any suitable length listed in table 2 (below). Tabletop 2702 may have a width W. Width W may be any suitable width listed in table 3 (below). Tabletop 2702 may include a height $H_1$. Height $H_1$ may be any suitable height of a tabletop. Length L, width W, and height $H_1$ may vary. Length L, width W, and height $H_1$ may be customizable.

Heavy-duty table 2700 may include table legs 2704 and 2706. Table legs 2704 and 2706 may be adjustable legs. Table leg 2704 may include adjustable segment 2710. Table leg 2706 may include adjustable segment 2712. Table legs 2704 and 2706 may be adjustable by adjusting adjustable segment 2710 and 2712. $H_3$, the height of table legs 2704 and 2706 in addition to $H_1$ may define the height, $H_2$, of heavy-duty table 2700. Height $H_2$ may be any height included in the range of heights listed in table 4 (below).

Figure 28:
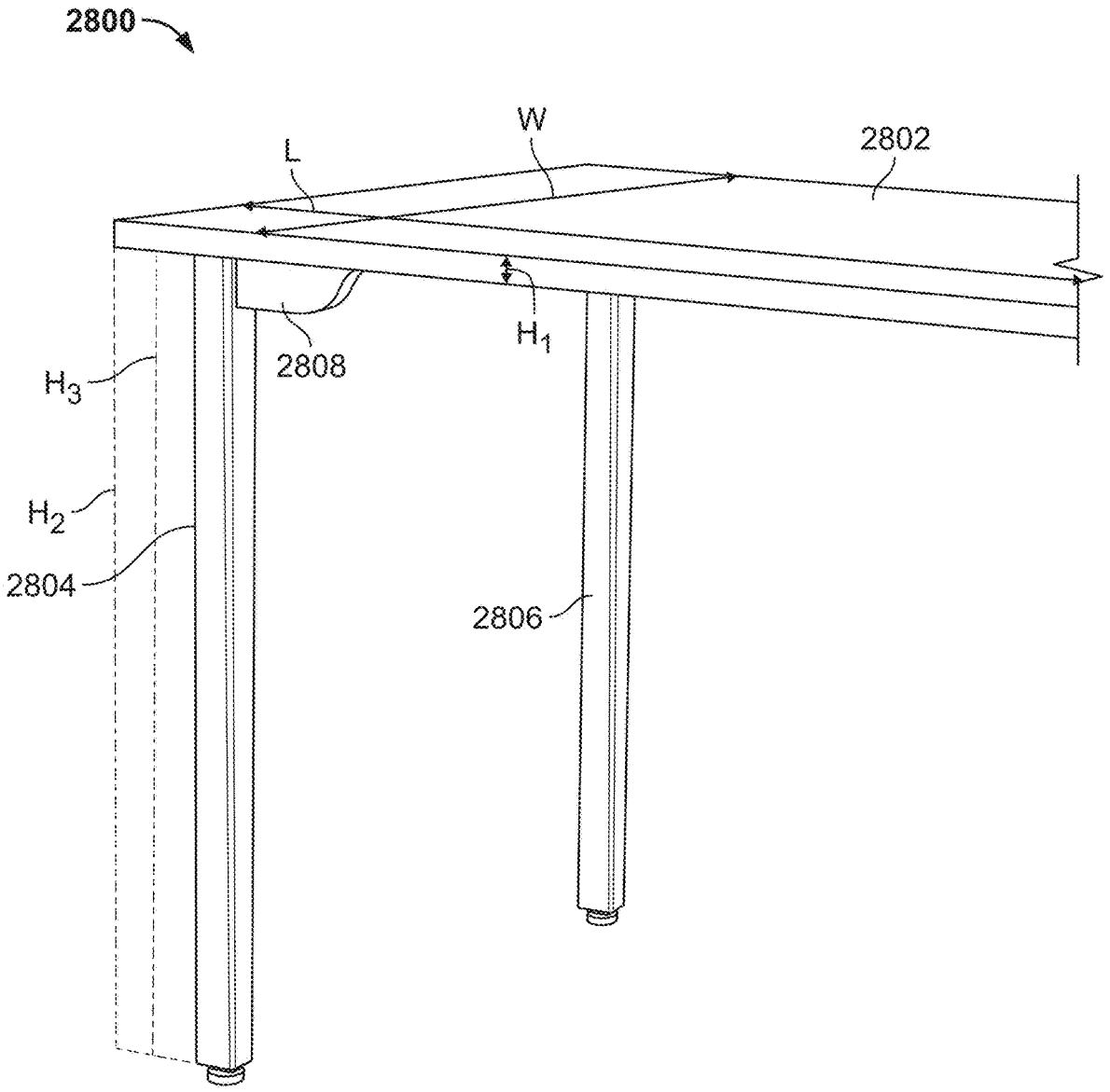
FIG. 28 is a side view of a wheelchair-accessible heavy-duty table, an illustrative system in accordance with principles of the disclosure.

FIG. 28 shows an illustrative view of heavy-duty table 2800. Heavy-duty table 2800 may have one or more feature in common with one or more of heavy-duty tables 1802 and 1902.

Heavy-duty table 2800 may include tabletop 2802. Tabletop 2802 may have a length L. Length L may be any suitable length listed in table 2 (below). Tabletop 2802 may have a width W. Width W may be any suitable width listed in table 3 (below). Tabletop 2802 may include a height $H_1$. Height $H_1$ may be any suitable height of a tabletop. Length L, width W, and height $H_1$ may vary. Length L, width W, and height $H_1$ may be customizable.

Heavy-duty table 2800 may include table legs 2804 and 2806. Table legs 2804 and 2806 may be fixed height legs. $H_3$, the height of table legs 2804 and 2806 in addition to $H_1$ may define the height, $H_2$, of heavy-duty table 2800. Height $H_2$ may be any height included in the range of heights listed in table 5 (below).

Figure 29:
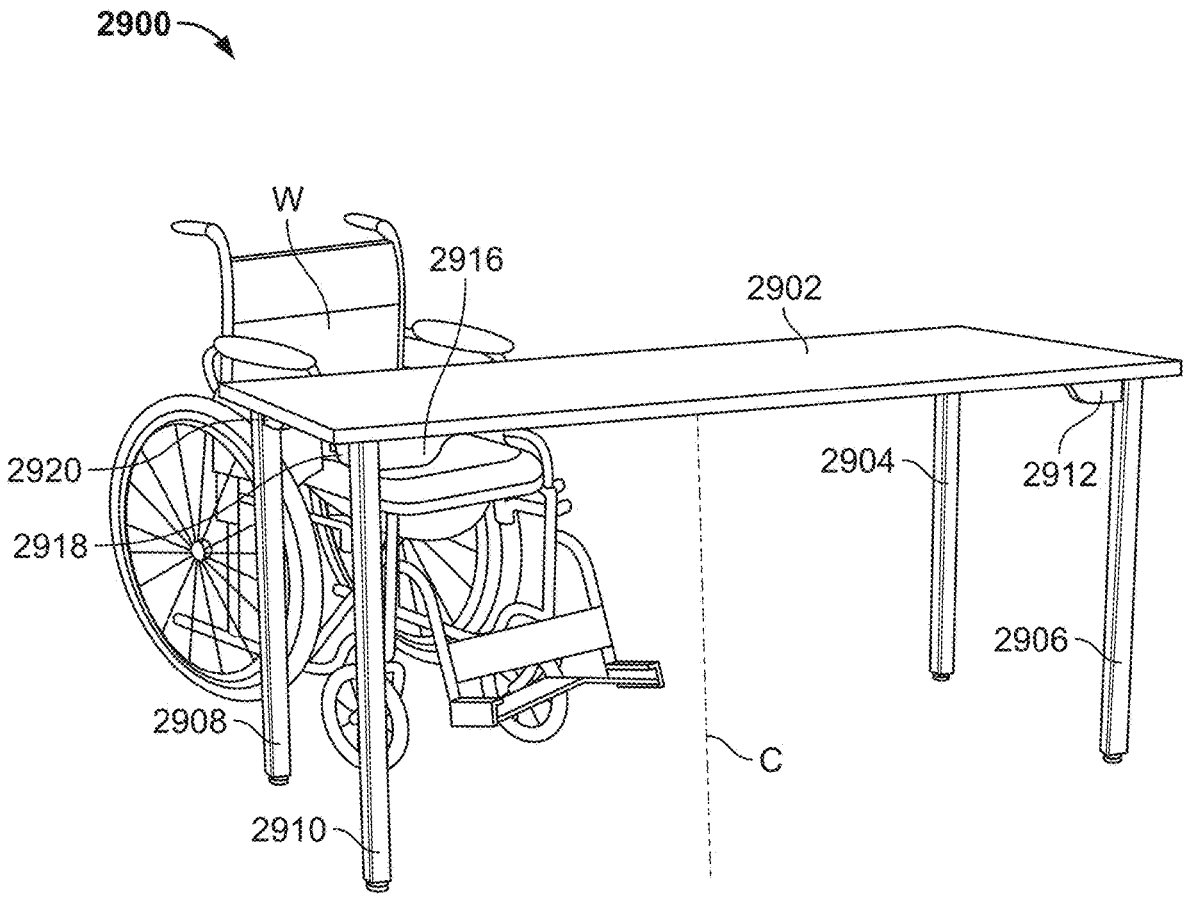
FIG. 29 is a side view of a wheelchair-accessible heavy-duty table, an illustrative system in accordance with principles of the disclosure.

FIG. 29 shows an illustrative view of heavy-duty table 2900. Heavy-duty table 2900 may include tabletop 2902. Heavy-duty table 2900 may include table legs 2904, 2906, 2908 and 2910. Table legs 2904, 2906, 2908 and 2910 may be mounted to four corners of tabletop 2902. A height of table legs 2904, 2906, 2908 and 2910 may define clearance C under heavy-duty table 2900. Because heavy-duty table 2900 is supported by apron ends, such as apron ends 2912, 2916, 2918 and 2920 and apron supports (not shown), clearance C may enable heavy-duty table 2900 to be wheelchair accessible. Because apron ends 2912, 2916, 2918 and 2920 only extend in the corners of heavy-duty table 2900, heavy-duty table 2900 may be accessible by wheelchair W. Because clearance C enables wheelchair W to access heavy-duty table 2900, heavy-duty table may be ADA compliant.

ADA compliance for a wheelchair-accessible table may require a maximum and minimum table height of about 34 inches and about 28 inches, respectively. ADA compliance for a wheelchair-accessible table may require knee clearance of a minimum of about 27 inches, from the floor to the bottom of the table surface. ADA compliance for a wheelchair-accessible table may require a clear floor area of about 30 inches by about 48 inches needed at each seating area. ADA compliance for a wheelchair-accessible table may require knee clearance that extends at least about 19 inches under the table.

Figure 30A:
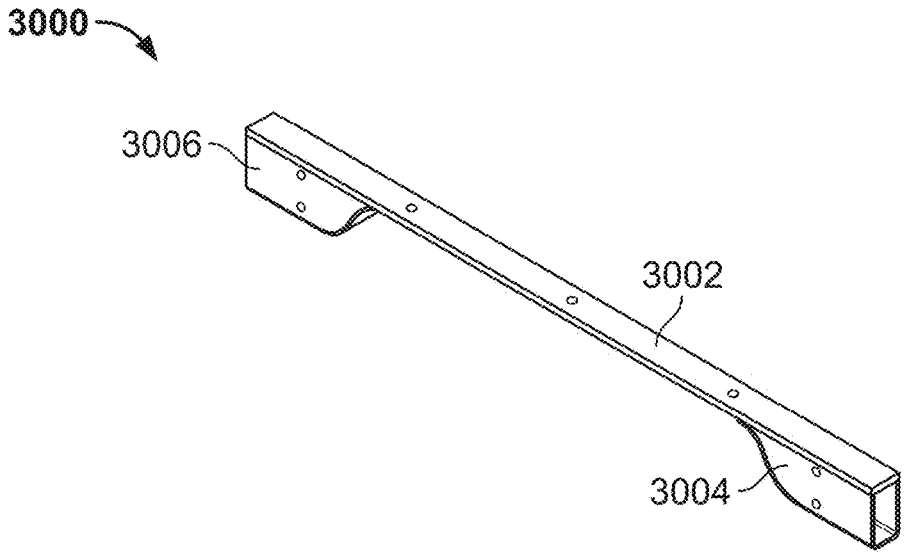
FIG. 30A is a top view of two aprons that may be mounted to a wheelchair-accessible heavy-duty table, an illustrative system in accordance with principles of the disclosure.

FIG. 30A shows an illustrative view of apron 3000. Apron 3000 may include one or more features in common with apron 2000. Apron 3000 may include apron support 3002. Apron ends 3004 and 3006 may be welded to apron support 3002.

Figure 30B:
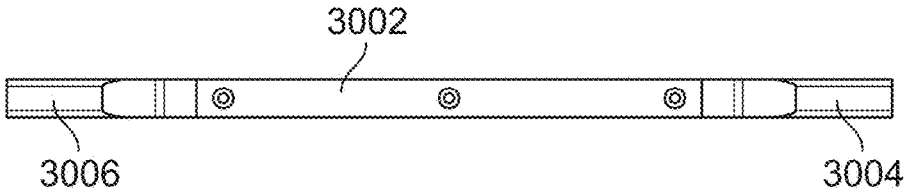
FIG. 30B is a bottom view of two aprons that may be mounted to a wheelchair-accessible heavy-duty table, an illustrative system in accordance with principles of the disclosure.

FIG. 30B shows a top view of apron 3000.

Figure 30C:
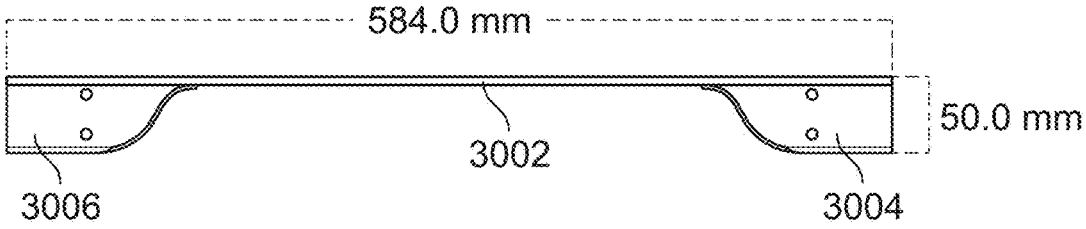
FIG. 30C is a side view with measurements of two aprons that may be mounted to a wheelchair-accessible heavy-duty table, an illustrative system in accordance with principles of the disclosure.

FIG. 30C shows a side view of apron 3000. Apron support 3002 may have a length of about 584.0 mm. Apron 3000 may have a height of about 50.0 mm.

Figure 31A:
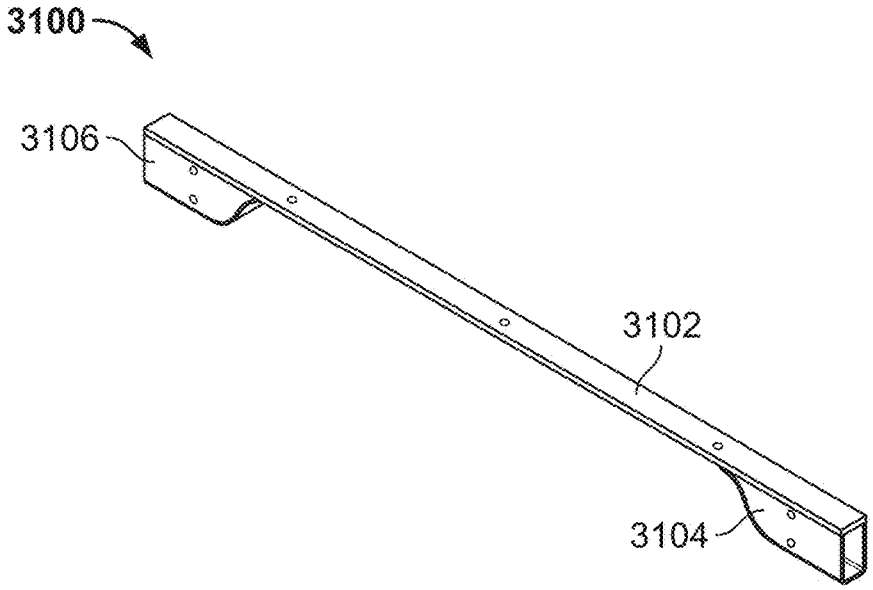
FIG. 31A is a top view of two aprons that may be mounted to a wheelchair-accessible heavy-duty table, an illustrative system in accordance with principles of the disclosure.

FIG. 31A shows an illustrative view of apron 3100. Apron 3100 may include one or more features in common with apron 2000. Apron 3100 may include apron support 3102. Apron ends 3104 and 3106 may be welded to apron support 3102.

Figure 31B:
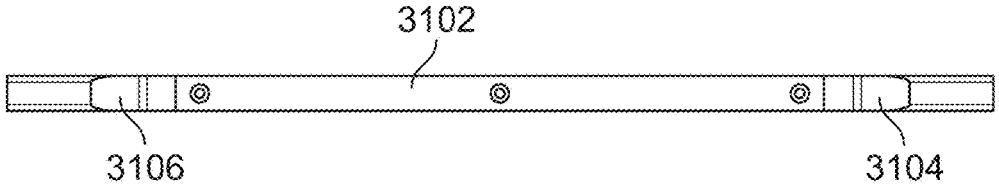
FIG. 31B is a bottom view of two aprons that may be mounted to a wheelchair-accessible heavy-duty table, an illustrative system in accordance with principles of the disclosure.

FIG. 31B shows a top view of apron 3100.

Figure 31C:
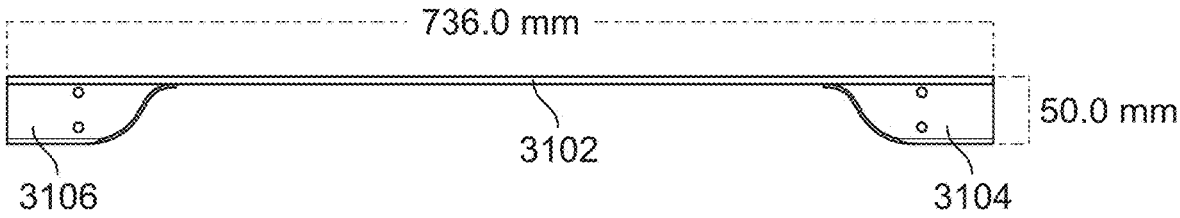
FIG. 31C is a side view with measurements of two aprons that may be with principles of the disclosure.

FIG. 31C shows a side view of apron 3100. Apron support 3102 may have a length of about 736.0 mm. Apron 3100 may have a height of about 50.0 mm.

Figure 32A:
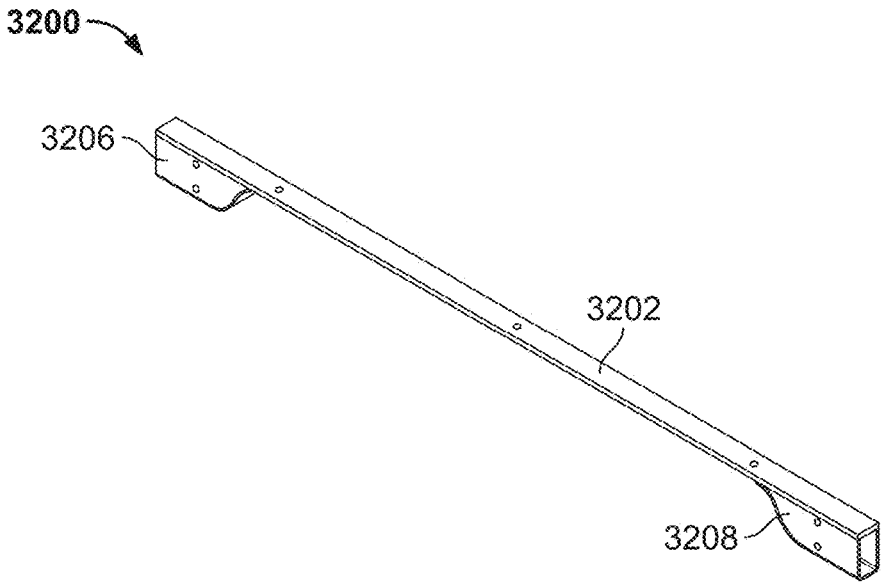
FIG. 32A is a top view of two aprons that may be mounted to a wheelchair-accessible heavy-duty table, an illustrative system in accordance with principles of the disclosure.

FIG. 32A shows an illustrative view of apron 3200. Apron 3200 may include one or more features in common with apron 2000. Apron 3200 may include apron support 3202. Apron ends 3206 and 3208 may be welded to apron support 3202.

Figure 32B:
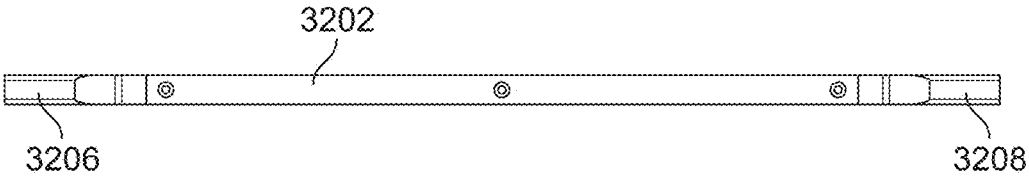
FIG. 32B is a bottom view of two aprons that may be mounted to a wheelchair-accessible heavy-duty table, an illustrative system in accordance with principles of the disclosure.

FIG. 32B shows a top view of apron support 3200.

Figure 32C:
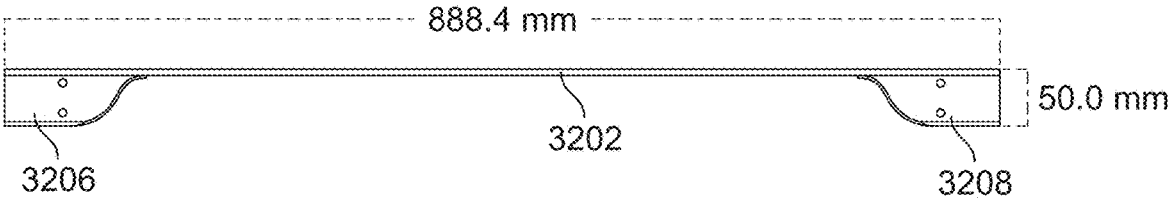
FIG. 32C is a side view with measurements of two aprons that may be mounted to a wheelchair-accessible heavy-duty table, an illustrative system in accordance with principles of the disclosure.

FIG. 32C shows a side view of apron 3200. Apron support 3202 may have a length of about 888.4 mm. Apron 3200 may have a height of about 50.0 mm.

Figure 33A:
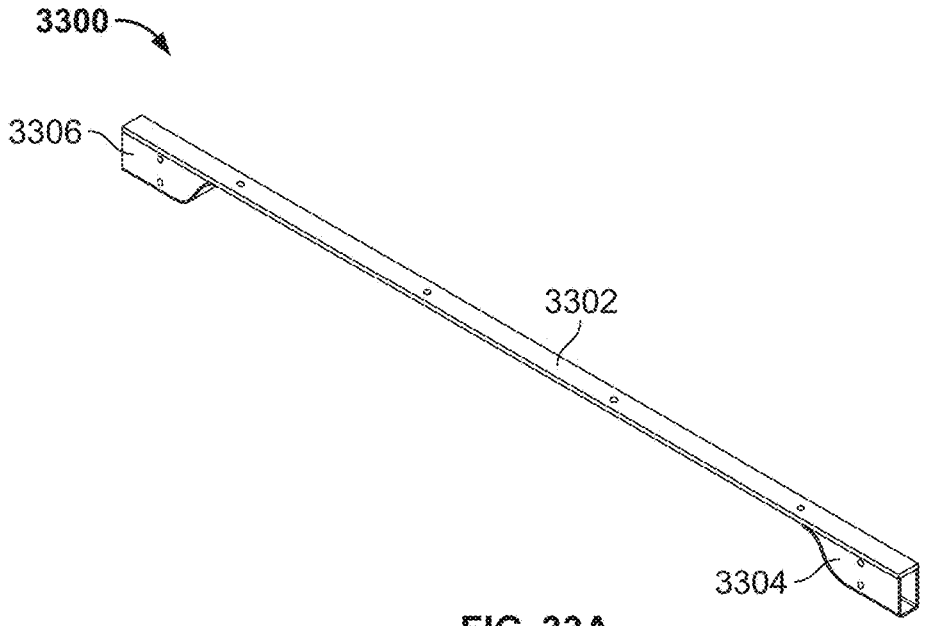
FIG. 33A is a top view of two aprons that may be mounted to a wheelchair-accessible heavy-duty table, an illustrative system in accordance with principles of the disclosure.

FIG. 33A shows an illustrative view of apron 3300. Apron 3300 may include one or more features in common with apron 2000. Apron 3300 may include apron support 3302. Apron ends 3304 and 3306 may be welded to apron support 3302.

Figure 33B:
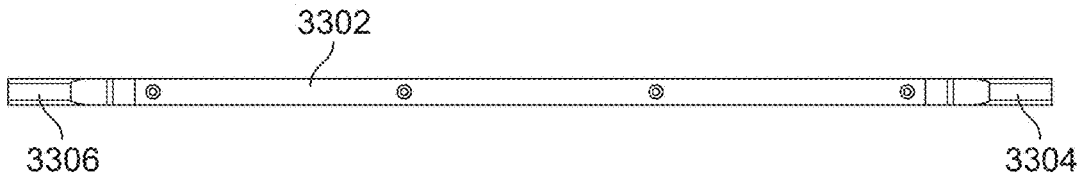
FIG. 33B is a bottom view of two aprons that may be mounted to a wheelchair-accessible heavy-duty table, an illustrative system in accordance with principles of the disclosure.

FIG. 33B shows a top view of apron 3300.

Figure 33C:
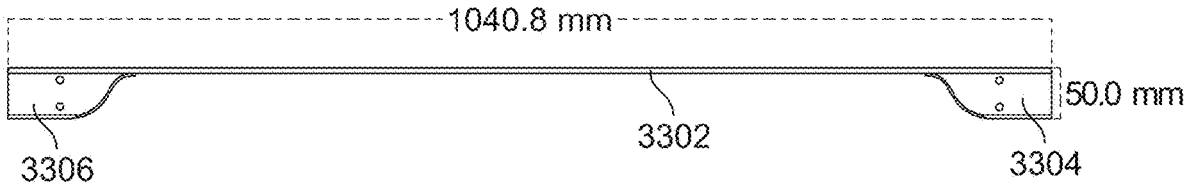
FIG. 33C is a side view with measurements of two aprons that may be mounted to a wheelchair-accessible heavy-duty table, an illustrative system in accordance with principles of the disclosure.

FIG. 33C shows a side view of apron 3300. Apron support 3302 may have a length of about 1040.8 mm. Apron 3300 may have a height of about 50.0 mm.

Figure 34A:
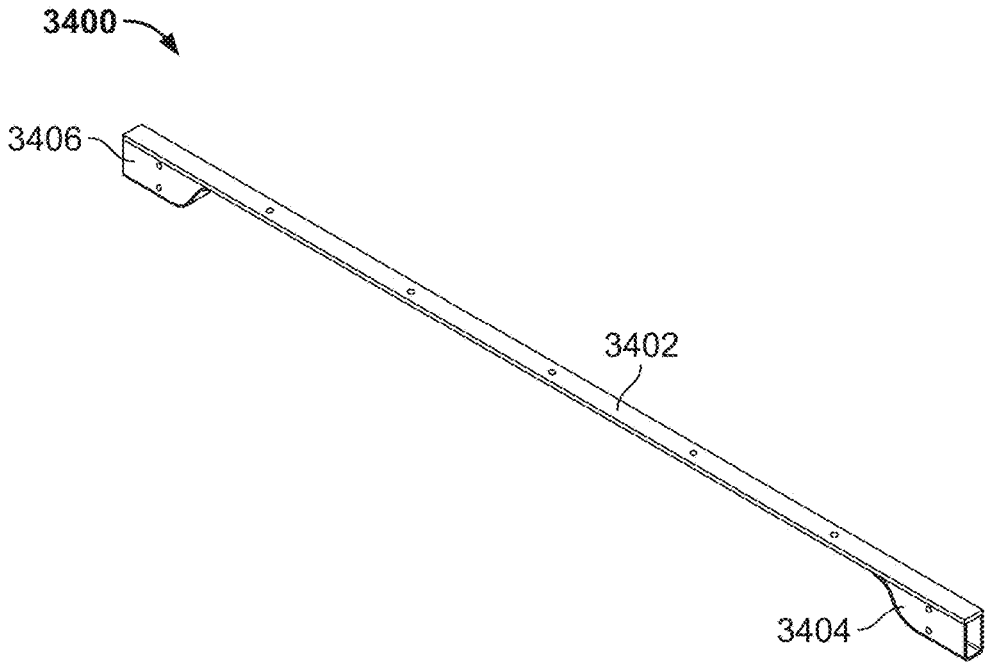
FIG. 34A is a top view of two aprons that may be mounted to a wheelchair-accessible heavy-duty table, an illustrative system in accordance with principles of the disclosure.

FIG. 34A shows an illustrative view of apron 3400. Apron 3400 may include one or more features in common with apron 2000. Apron 3400 may include apron support 3402. Apron ends 3404 and 3406 may be welded to apron support 3402.

Figure 34B:
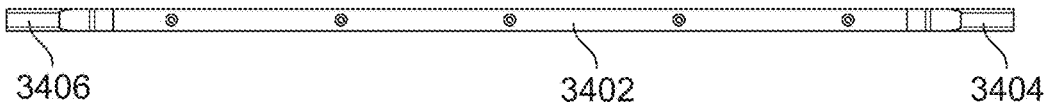
FIG. 34B is a bottom view of two aprons that may be mounted to a wheelchair-accessible heavy-duty table, an illustrative system in accordance with principles of the disclosure.

FIG. 34B shows a top view of apron 3400.

Figure 34C:
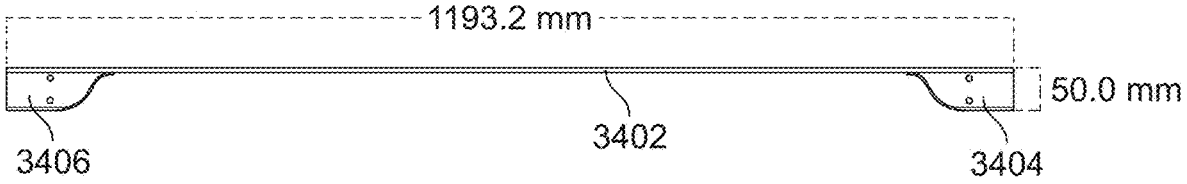
FIG. 34C is a side view with measurements of two aprons that may be with principles of the disclosure.

FIG. 34C shows a side view of apron 3400. Apron support 3402 may have a length of about 1193.2 mm. Apron 3400 may have a height of about 50.0 mm.

Figure 35A:
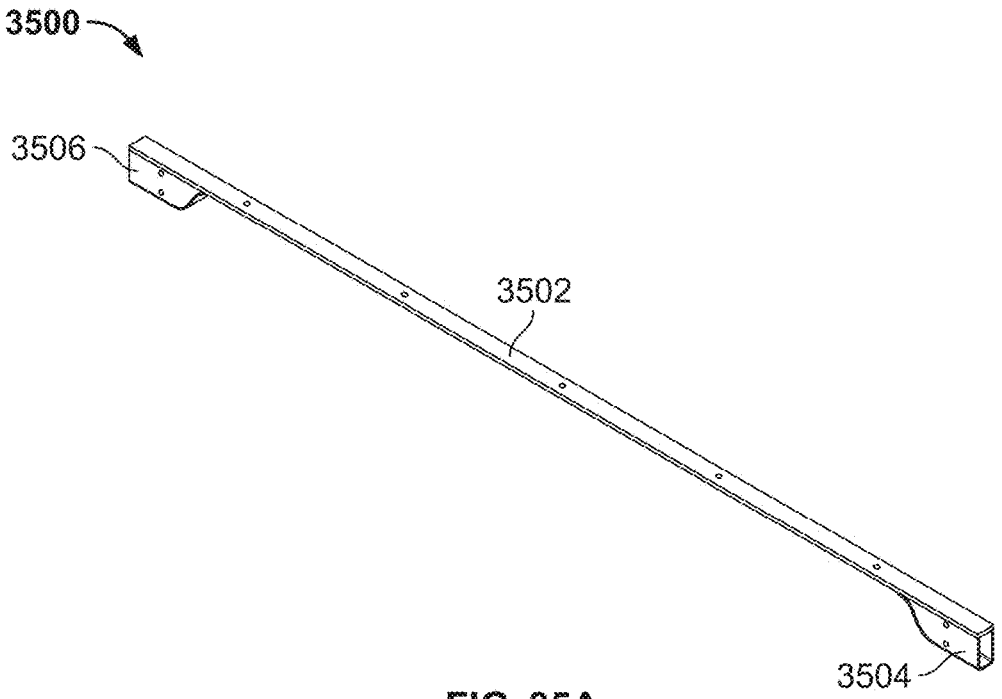
FIG. 35A is a top view of two aprons that may be mounted to a wheelchair-accessible heavy-duty table, an illustrative system in accordance with principles of the disclosure.

FIG. 35A shows an illustrative view of apron 3500. Apron 3500 may include one or more features in common with apron 2000. Apron 3500 may include apron support 3502. Apron ends 3504 and 3506 may be welded to apron support 3502.

Figure 35B:
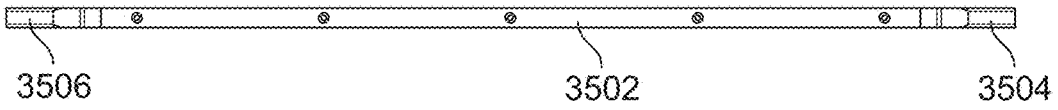
FIG. 35B is a bottom view of two aprons that may be mounted to a wheelchair-accessible heavy-duty table, an illustrative system in accordance with principles of the disclosure.

FIG. 35B shows a top view of apron 3500.

Figure 35C:
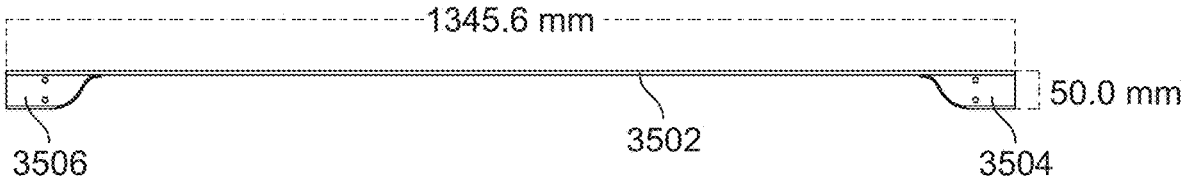
FIG. 35C is a side view with measurements of two aprons that may be mounted to a wheelchair-accessible heavy-duty table, an illustrative system in accordance with principles of the disclosure.

FIG. 35C shows a side view of apron 3500. Apron support 3502 may have a length of about 1345.6 mm. Apron 3500 may have a height of about 50.0 mm.

Figure 36A:
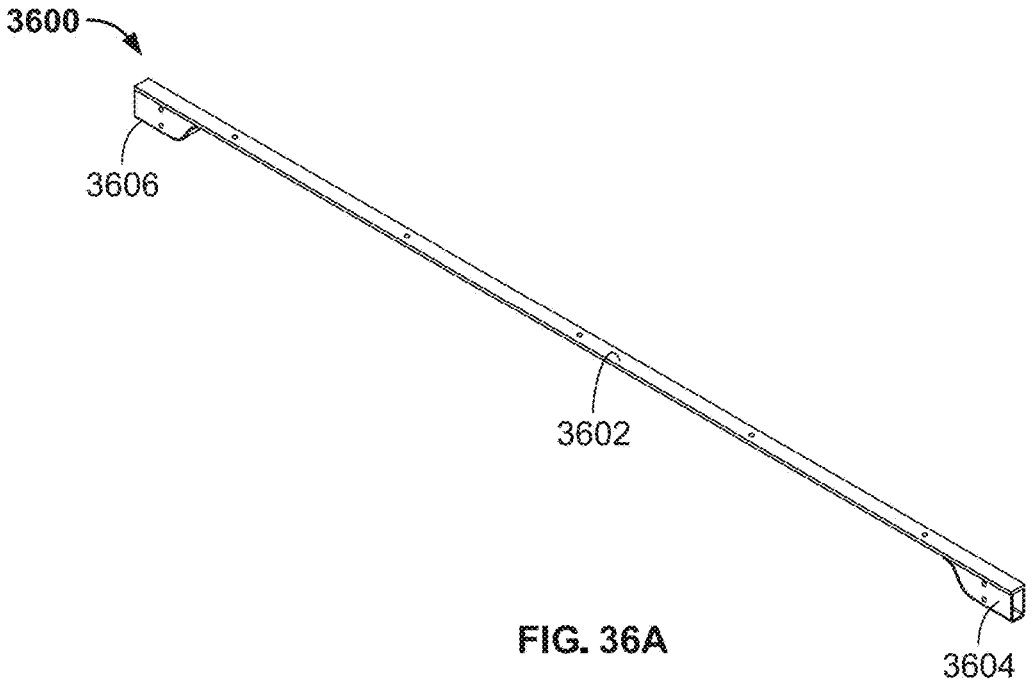
FIG. 36A is a top view of two aprons that may be mounted to a wheelchair-accessible heavy-duty table, an illustrative system in accordance with principles of the disclosure.

FIG. 36A shows an illustrative view of apron 3600. Apron 3600 may include one or more features in common with apron 2000. Apron 3600 may include apron support 3602. Apron ends 3604 and 3606 may be welded to apron support 3602.

Figure 36B:
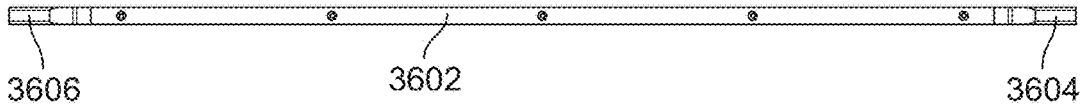
FIG. 36B is a bottom view of two aprons that may be mounted to a wheelchair-accessible heavy-duty table, an illustrative system in accordance with principles of the disclosure.

FIG. 36B shows a top view of apron 3600.

Figure 36C:
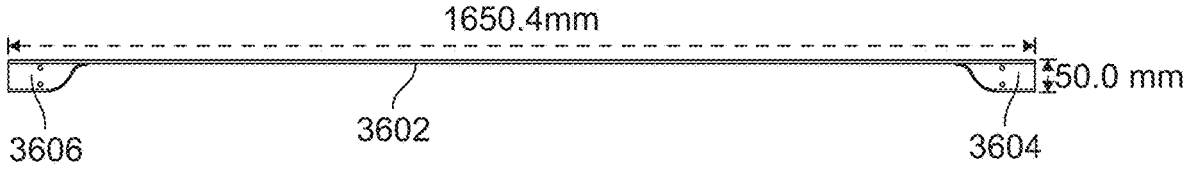
FIG. 36C is a side view with measurements of two aprons that may be mounted to a wheelchair-accessible heavy-duty table, an illustrative system in accordance with principles of the disclosure.

FIG. 36C shows a side view of apron 3600. Apron support 3602 may have a length of about 1650.4 mm. Apron 3600 may have a height of about 50.0 mm.

Figure 37A:
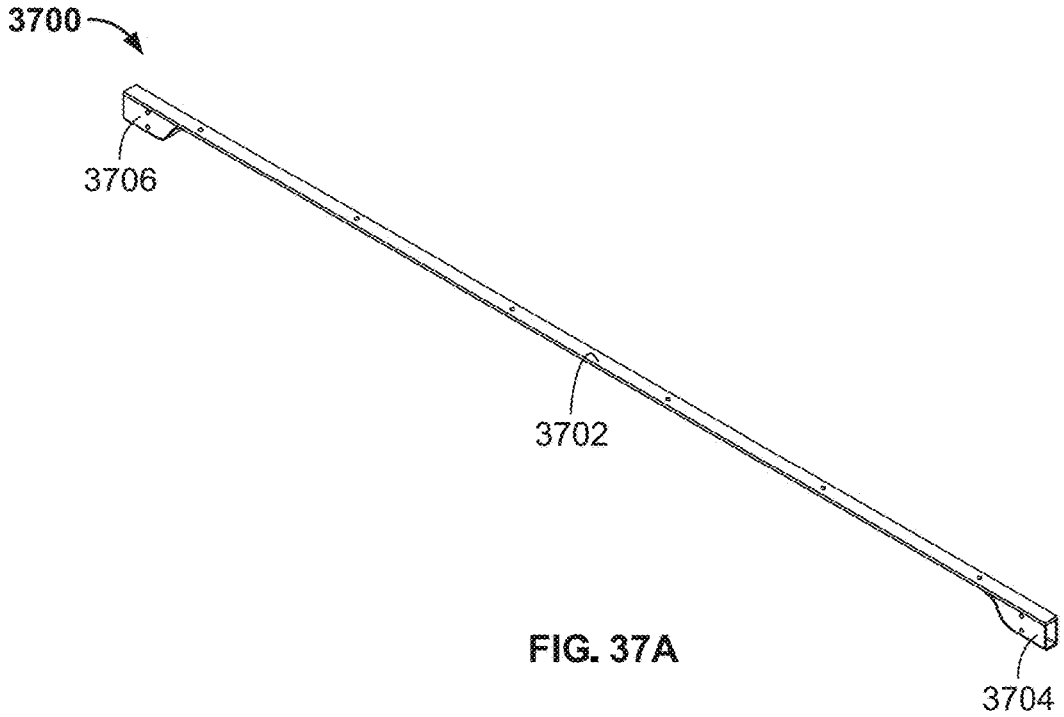
FIG. 37A is a top view of two aprons that may be mounted to a wheelchair-accessible heavy-duty table, an illustrative system in accordance with principles of the disclosure.

FIG. 37A shows an illustrative view of apron 3700. Apron 3700 may include one or more features in common with apron 2000. Apron 3700 may include apron support 3702. Apron ends 3704 and 3706 may be welded to apron support 3702.

Figure 37B:
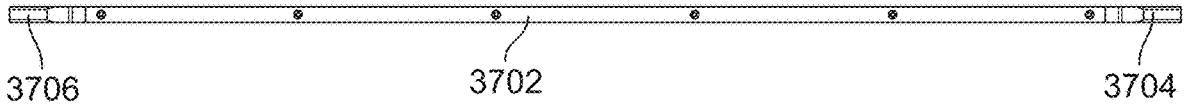
FIG. 37B is a bottom view of two aprons that may be mounted to a wheelchair-accessible heavy-duty table, an illustrative system in accordance with principles of the disclosure.

FIG. 37B shows a top view of apron 3700.

Figure 37C:
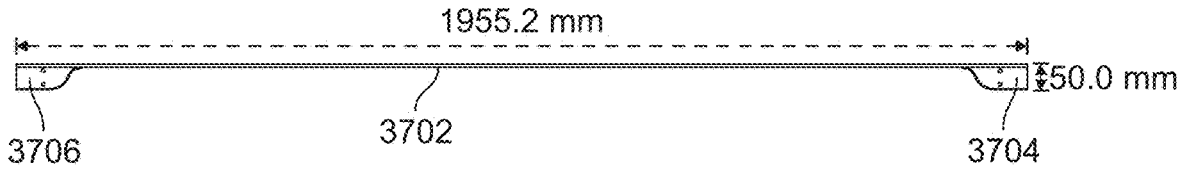
FIG. 37C is a side view with measurements of two aprons that may be with principles of the disclosure.

FIG. 37C shows a side view of apron 3700. Apron support 3702 may have a length of about 1955.2 mm. Apron 3700 may have a height of about 50.0 mm.

Figure 38A:
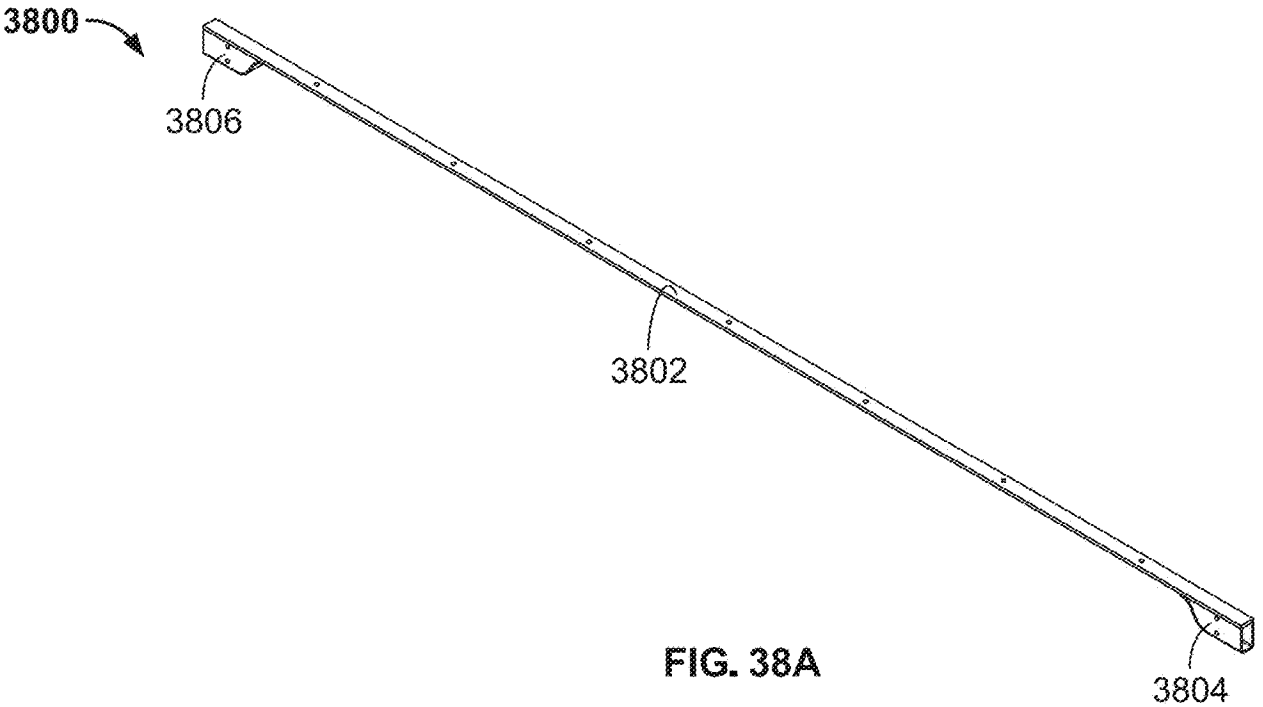
FIG. 38A is a top view of two aprons that may be mounted to a wheelchair-accessible heavy-duty table, an illustrative system in accordance with principles of the disclosure.

FIG. 38A shows an illustrative view of apron 3800. Apron 3800 may include one or more features in common with apron 2000. Apron 3800 may include apron support 3802. Apron ends 3804 and 3806 may be welded to apron support 3802.

Figure 38B:
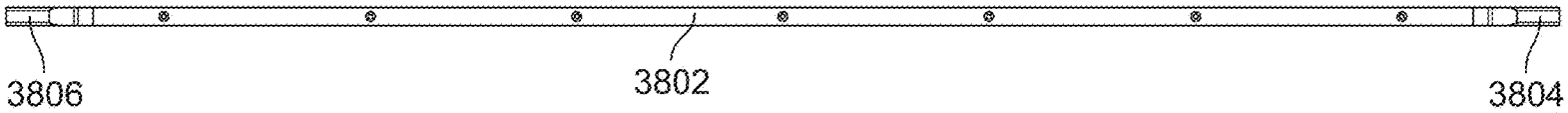
FIG. 38B is a bottom view of two aprons that may be mounted to a wheelchair-accessible heavy-duty table, an illustrative system in accordance with principles of the disclosure.

FIG. 38B shows a top view of apron 3800.

Figure 38C:
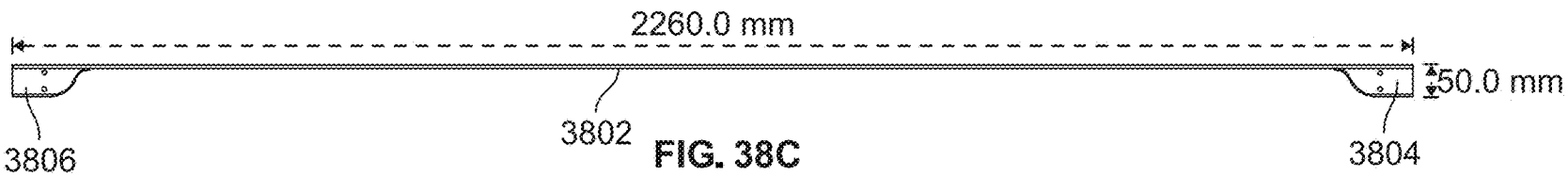
FIG. 38C is a side view with measurements of two aprons that may be mounted to a wheelchair-accessible heavy-duty table, an illustrative system in accordance with principles of the disclosure.

FIG. 38C shows a side view of apron 3800. Apron support 3802 may have a length of about 2260.0 mm. Apron 3800 may have a height of about 50.0 mm.

Figure 39:
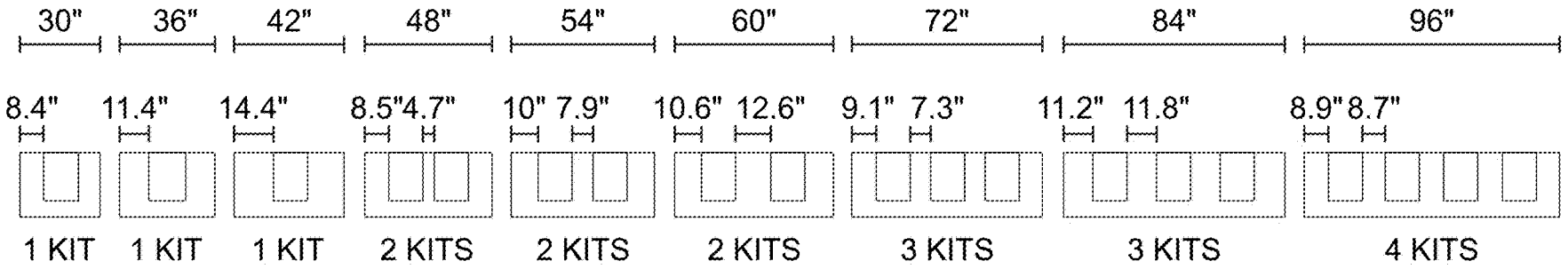
FIG. 39 is a top view of wheelchair-accessible heavy-duty tables with various dimensions and amounts of tote tray holders, one through four, illustrative systems in accordance with principles of the disclosure.

FIG. 39 shows top views of wheelchair-accessible heavy-duty tables with various dimensions and number of tote tray holders. A heavy-duty table that is about 30, 36, and 42 inches wide may include up to one tote tray holder. A heavy-duty table that is about 48, 54, and 60 inches wide may include up to two tote tray holders. A heavy-duty table that is about 72 and 84 inches wide may include up to three tote tray holders. And a heavy-duty table that is about 96 inches wide may include up to four tote tray holders.

Figure 40:
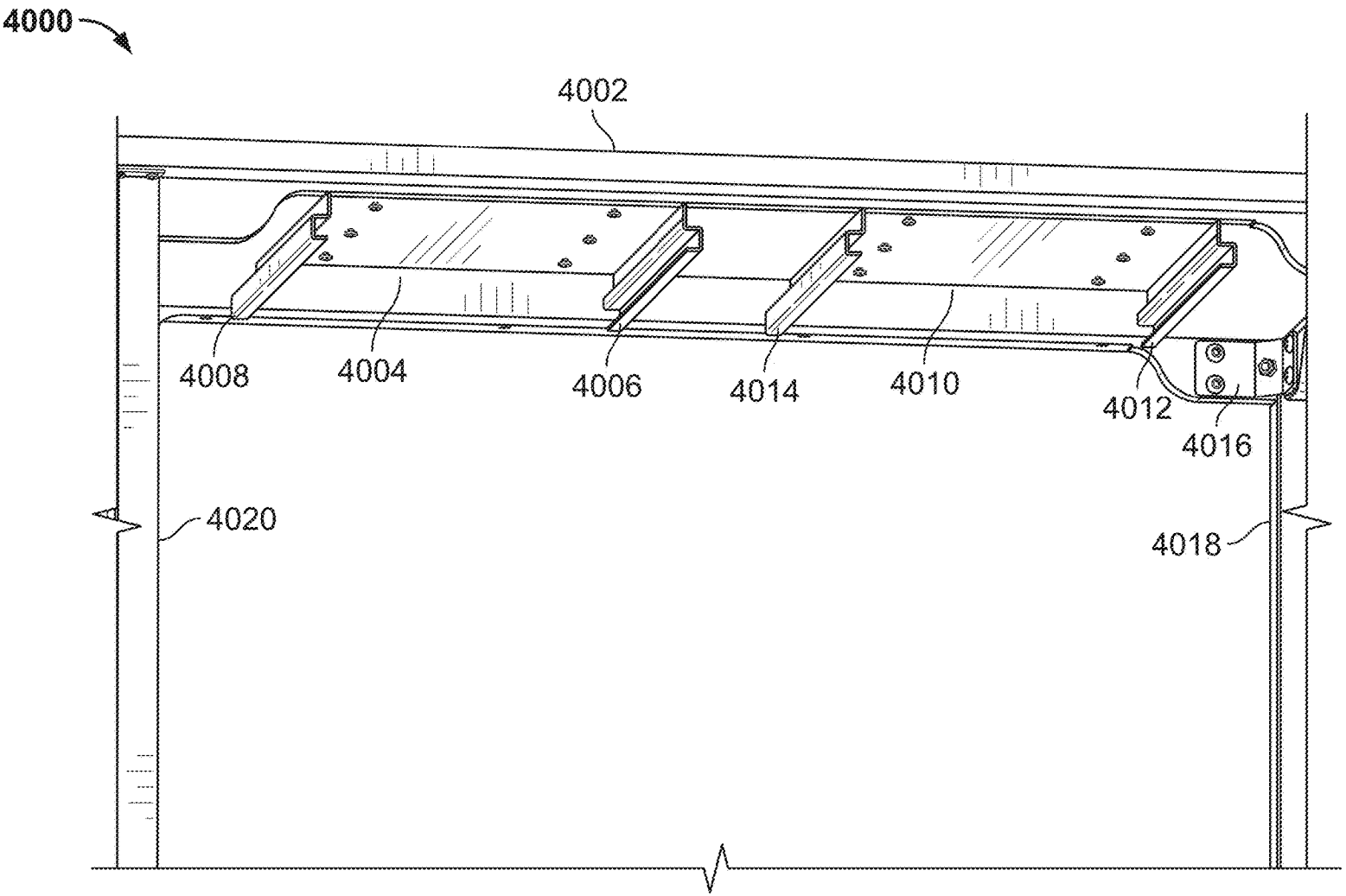
FIG. 40 is a bottom side view of two tote tray holders in the wheelchair-accessible heavy-duty table with c-shaped detents, an illustrative system in accordance with principles of the disclosure.

FIG. 40 shows a bottom side view 4000 of two tote tray holders, 4004 and 4010, with c-shaped detents, 4006, 4008, 4012, and 4014, in the wheelchair-accessible heavy-duty table 4002.

Wheelchair-accessible heavy-duty table 4002 may include legs, 4020 and 4018. The legs, 4020 and 4018, may be connected to the wheelchair-accessible heavy-duty table 4002 by mounting screws on apron 4016.

Figure 41:
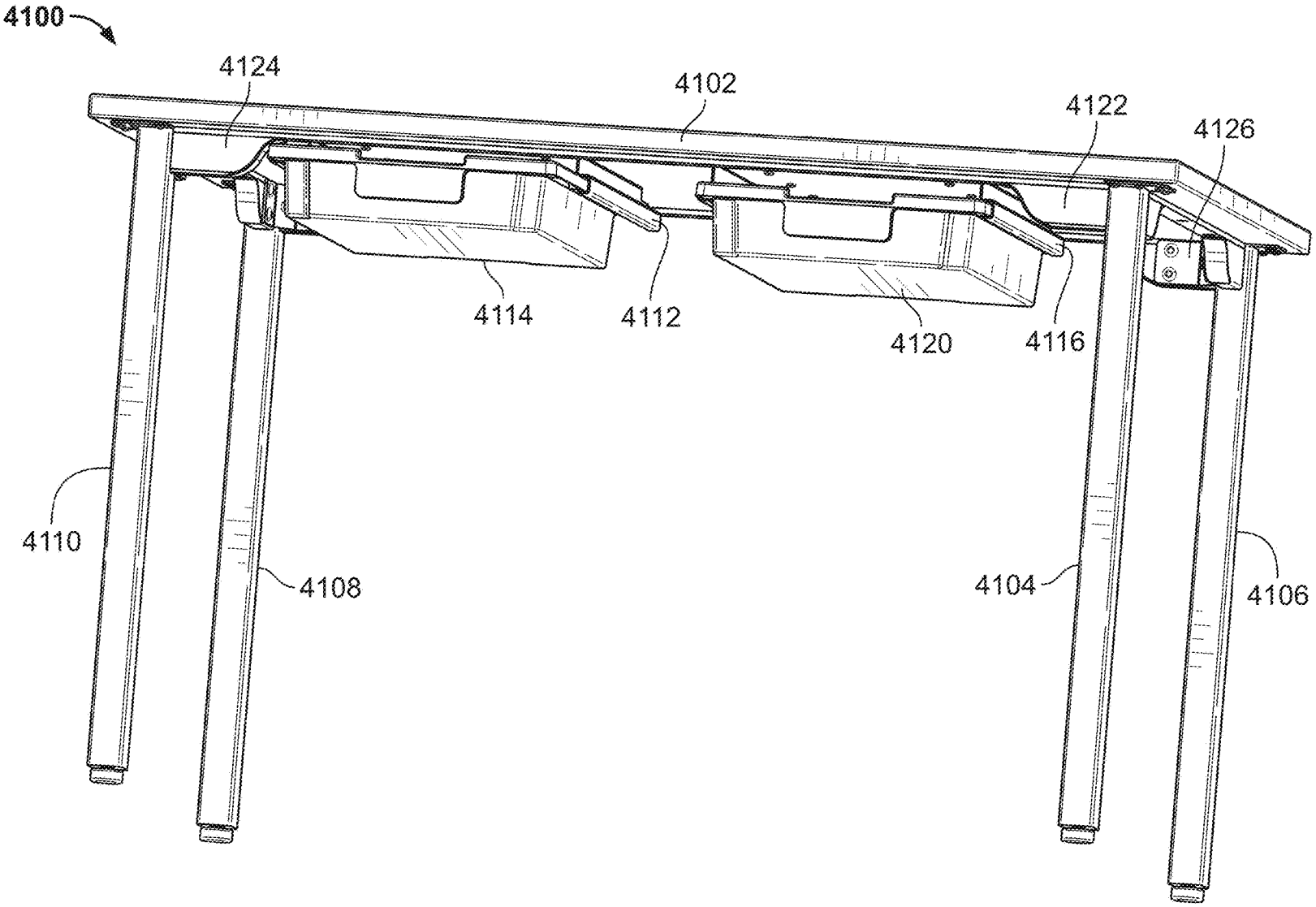
FIG. 41 is a side view of two tote tray holders in the wheelchair-accessible heavy-duty table with c-shaped detents, holding two tote trays, an illustrative system in accordance with principles of the disclosure.

FIG. 41 shows a side view 4100 of two tote tray holders, 4112 and 4116, with c-shaped detents in the wheelchair-accessible heavy-duty table 4102, holding two tote trays, 4114 and 4120.

Wheelchair-accessible heavy-duty table 4102 may include legs, 4104, 4106, 4108, and 4110. The legs, 4104, 4106, 4108, and 4110, may be connected to the wheelchair-accessible heavy-duty table 4102 by mounting screws on aprons 4122, 4124, and 4126. Wheelchair-accessible heavy-duty table 4102 may include up to four aprons, for example, aprons 4122, 4124, and 4126 (one is not shown).

Figure 42:
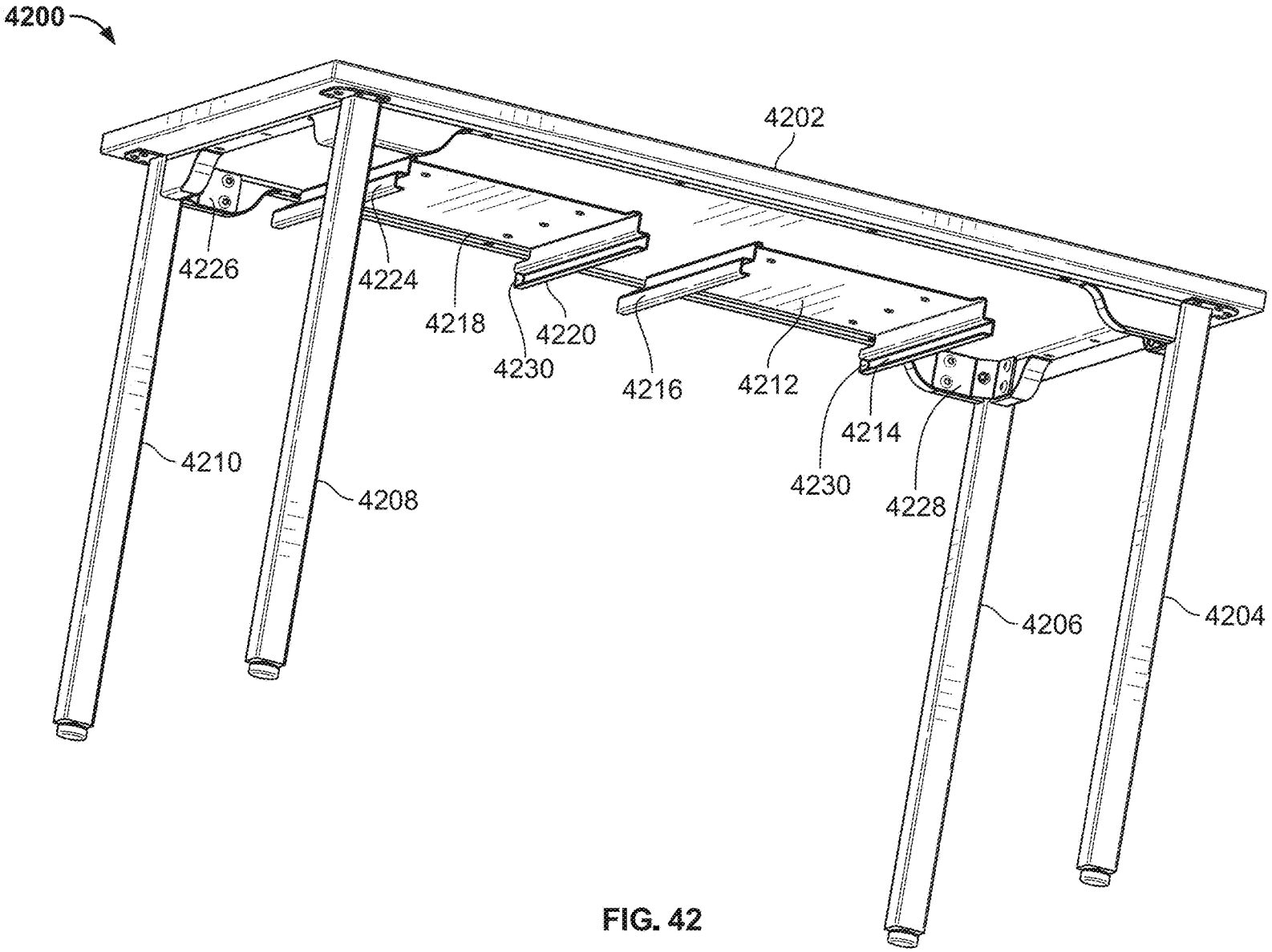
FIG. 42 is a bottom side view of two tote tray holders in the wheelchair-accessible heavy-duty table with c-shaped detents, an illustrative system in accordance with principles of the disclosure.

FIG. 42 shows a bottom side view 4200 of two tote tray holders, 4212 and 4218, with c-shaped detents, 4214, 4216, 4220, and 4224, as well as fold tabs 4230, in the wheelchair-accessible heavy-duty table 4202.

Wheelchair-accessible heavy-duty table 4202 may include legs, 4204, 4206, 4208, and 4210. The legs, 4204, 4206, 4208, and 4210, may be connected to the wheelchair-accessible heavy-duty table 4202 by mounting screws on aprons, 4226 and 4228. Wheelchair-accessible heavy-duty table 4202 may include up to four aprons, for example, aprons, 4226 and 4228.

Figure 43:
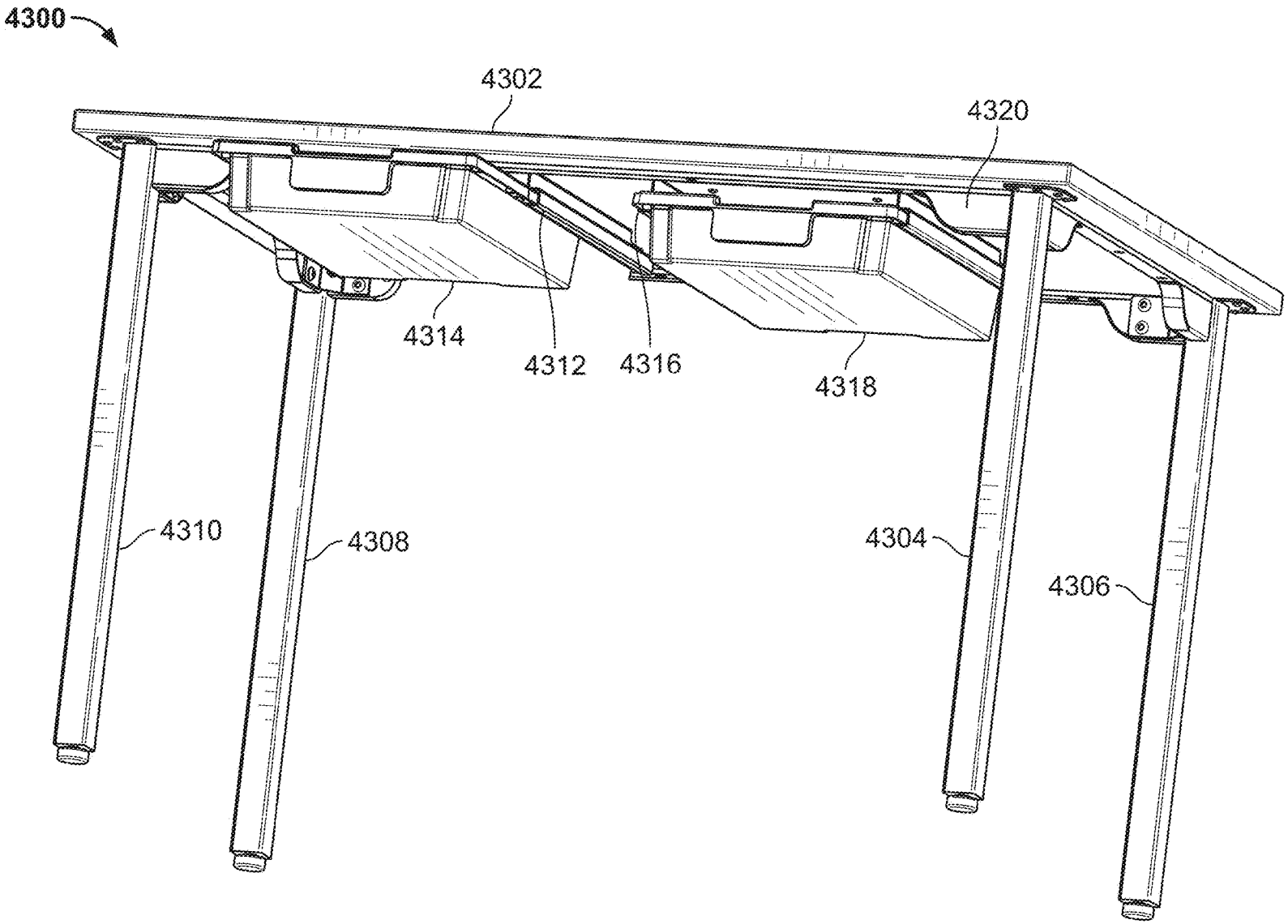
FIG. 43 is a side view of two tote tray holders in the wheelchair-accessible heavy-duty table with c-shaped detents, holding two tote trays, an illustrative system in accordance with principles of the disclosure.

FIG. 43 shows a side view 4300 of two tote tray holders, 4312 and 4316, with c-shaped detents in the wheelchair-accessible heavy-duty table 4302, holding two tote trays, 4314 and 4318.

Wheelchair-accessible heavy-duty table 4302 may include legs, 4304, 4306, 4308, and 4310. The legs, 4304, 4306, 4308, and 4310, may be connected to the wheelchair-accessible heavy-duty table 4302 by mounting screws on aprons, e.g., 4320. Wheelchair-accessible heavy-duty table 4302 may include up to four aprons, for example, apron 4320.

The heavy-duty table may include a tabletop. The tabletop may include a plurality of corners. The tabletop may be rectangular. The tabletop may be hexagonal, octagonal, square, or any suitable tabletop shape. The tabletop may be made partly or wholly out of material. Table 1 shows illustrative materials that may include the material of the tabletop.

TABLE 1

| Illustrative tabletop materials. |
|---|
| Wood |
| Plastic |
| Metal |
| Standard-high pressure laminate |
| Supreme-high pressure laminate |
| Whiteboard |
| Chem-res |
| Phenolic |
| Trespa |
| Butcherblock |
| Any other suitable materials |
| Any suitable combination thereof |

A size of the tabletop may be customizable. Table 2 shows illustrative tabletop lengths. Table 3 shows illustrative tabletop widths.

TABLE 2

| Illustrative tabletop lengths. |
|---|
| 24 inches |
| 30 inches |
| 36 inches |
| 42 inches |
| 48 inches |
| 54 inches |
| 60 inches |
| 72 inches |
| Any other suitable length |

TABLE 3

| Illustrative tabletop widths. |
|---|
| 18 inches |
| 24 inches |
| 30 inches |
| Any other suitable width |

The heavy-duty table may include a plurality of table legs. The plurality of table legs may include steel. The plurality of table legs may include any other suitable material. Each of the table legs may be disposed at a corresponding one of the plurality of corners of the tabletop. For example, if a tabletop is a hexagonal shape, the heavy-duty table may include six legs, each of the six table legs may be disposed at a corner of the hexagonal tabletop.

Each of the plurality of table legs may include a first inner side and a second inner side. Each of the plurality of table legs may include a first outer side and second outer side. The first inner side and second inner side may intersect at a 90° angle. The first outer side may intersect the first inner side at a 90° angle. The first outer side may intersect the second outer side at a 90° angle. The second outer side may intersect the second inner side at a 90° angle. The first and second inner sides may be the sides of the table leg that faces toward an area defined by a bottom side of the tabletop. The first and second outer sides may be the sides of the table leg that faces the away from the area defined by the bottom side of the tabletop.

In some of the embodiments, the plurality of table legs may not include sides. The plurality of table legs may be circular.

The plurality of table legs may be height-adjustable table legs. The height-adjustable table legs may enable the adjustment of a height of the tabletop in relation to the ground. Table 4 shows illustrative ranges of the height of a table with height-adjustable legs (height, in relation to the adjustable table, is the height of the legs plus the height of tabletop).

TABLE 4

| Illustrative ranges of heights for the table with height-adjustable table legs. |
|---|
| <20.25 |
| 20.25 inches - 35.25 inches |
| 20.50 inches - 35.50 inches |
| 20.75 inches - 35.75 inches |
| 21.00 inches - 36.00 inches |
| 21.25 inches - 36.25 inches |
| 21.50 inches - 36.50 inches |
| 21.75 inches - 36.75 inches |
| 22.00 inches - 37.00 inches |
| 22.25 inches - 37.25 inches |
| >37.25 |
| Other suitable height ranges |

The plurality of table legs may be fixed-height legs. The fixed-height table legs may define a height of the heavy-duty table. Table 5 shows illustrative ranges of the height of a table with fixed height (height, in relation to the adjustable table, is the height of the legs plus the height of tabletop).

TABLE 5

| Illustrative ranges of heights for the table with fixed-height table legs. |
|---|
| <27.0 |
| 27.0 inches - 27.5 inches |
| 27.5 inches - 28.0 inches |
| 28.0 inches - 28.5 inches |
| 28.5 inches - 29.0 inches |
| 29.0 inches - 29.5 inches |
| 39.5 inches - 30.0 inches |
| 30.0 inches - 31.5 inches |
| 31.5 inches - 32.0 inches |
| >32.0 |
| Other suitable height ranges |

The clearance under the heavy-duty table may be in compliance with dimensions specified under ADA standards. A table that complies with ADA standards may be required to have a surface height of no more than 34 inches and no less than 28 inches above the floor. A table that complies with ADA standards may be required to provide at least 27 inches of knee clearance between the floor and an underside of the table. The knee clearance may be required to extend 19 inches under the table.

The height of the heavy-duty table may not be less than a predetermined minimum and not be greater than a predetermined maximum. As such, clearance under the heavy-duty table may be in line with ADA standards.

Table 6 shows illustrative ranges of heights of the heavy-duty table that may include the predetermined minimum and the predetermined maximum heights.

| Illustrative ranges of clearance under the heavy-duty table. |
|---|
| 28 inches - 30 inches |
| 28 inches - 31 inches |
| 28 inches - 32 inches |
| 28 inches - 33 inches |
| 28 inches - 34 inches |
| Other suitable height ranges |

The wheelchair-accessible heavy-duty table may include a tote tray holder. The tote tray holder may include a metal frame. The metal frame may include a flat top portion. The metal frame may include two side portions. Each of the two side portions may include an elongated portion. Each of the two side portions may include a c-shaped detent. The flat top portion may be configured to be mounted to the bottom side of the tabletop. The two side portions may be configured to slidably engage in respective edges of a tote tray.

The tote tray holder may include sheet metal. The sheet metal may include 14-gauge steel or any other suitable gauge steel. Sheet metal may include any suitable material. Table 7 shows illustrative ranges of the dimensions of the tote tray holder.

TABLE 7

| Illustrative ranges of the dimensions of the tote tray holder. |
|---|
| < 1 mm |
| 1 mm - 10 mm |
| 20 mm - 30 mm |
| 30 mm - 40 mm |
| 40 mm - 50 mm |
| 50 mm - 60 mm |
| 60 mm - 70 mm |
| 70 mm - 80 mm |
| 80 mm - 90 mm |
| 90 mm - 100 mm |
| 100 mm - 200 mm |
| 200 mm - 300 mm |
| 300 mm - 400 mm |
| > 400 mm |
| Other suitable dimension ranges |

The wheelchair-accessible heavy-duty table may include a different amount of tote tray holders per size table. For example, a table with 30-, 36-, and 42-inch width may include up to 1 tote tray holder. A table with 48-, 54-, and 60-inch width may include up to 2 tote tray holders. A table with 72- and 84-inch width may include up to 3 tote tray holders. And a table with 96-inch width may include up to 4 tote tray holders.

The heavy-duty table may include a plurality of aprons. The plurality of aprons may be table supports. Each of the plurality of aprons may include an apron support. The apron support may include sheet metal. The sheet metal may include 3-gauge. The sheet metal may include any other suitable gauge steel. The sheet metal may include any suitable material. Table 8 shows illustrative ranges of the height of the apron support. Table 9 shows illustrative ranges of the width of the apron support.

TABLE 8

| Illustrative ranges of the height of the apron support. |
|---|
| < 1 mm |
| 1 mm - 2 mm |
| 2 mm - 3 mm |
| 3 mm - 4 mm |
| 4 mm - 5 mm |
| 5 mm - 6 mm |
| 6 mm - 7 mm |
| > 7 mm |
| Other suitable height ranges |

TABLE 9

| Illustrative ranges of the width of the apron support. |
|---|
| 10 mm - 15 mm |
| 15 mm - 20 mm |
| 20 mm - 25 mm |
| 25 mm - 30 mm |
| 30 mm - 35 mm |
| 35 mm - 40 mm |
| Other suitable width ranges |

The apron support may be mounted to the bottom side of the tabletop. The apron support may be mounted between the inner side of the first table leg and an inner side of the second table leg. The apron support may be mounted to the bottom side of the tabletop using screws.

Each of the aprons may include two apron ends. Each of the two apron ends may include angular metal tubing. The angular metal tubing may include 13.5-gauge steel or any other suitable gauge steel. The angular metal tubing may include any suitable material. The angular metal tubing may include any other suitable material. Each of the apron ends may include a first side surface. Each of the apron ends may include a second side surface. The first side surface may be parallel to the second side surface. Each of the apron ends may include a bottom surface. The bottom surface may connect to the bottom edge of the first side surface and the bottom edge of the second side. Each of the apron ends may include a flat open end. The flat open end may be defined by an intersection of the first side surface, the second side surface and the bottom surface. Each of the apron ends may include a curved open end. The curved open end may be opposite the flat open end. The curved open end may be defined by a curved end of the first side surface, a curved end of the second side surface and an edge of the bottom surface. Each of the apron ends may include a top side. The top side may be parallel with the bottom side. The top side may be an open side defined by an edge of the first side surface and an edge of the second side surface.

Each of the two apron ends may include an apron end cover. The apron end cover may be welded to the curved end of the first side surface, the curved end of the second side surface, and an edge of the bottom surface. Following the welding, the apron end cover may convert the curved open end to a curved closed end.

One of the two apron ends may be welded to the apron support with the flat open end disposed adjacent the inner side of the first table leg. The other one of the two apron ends may be welded to the apron support with the flat open end disposed adjacent the inner side of the second table leg. One of the two apron supports may be welded to a first side of the apron support on one end of the apron support. The other one of the two apron ends may be welded to another other end of the apron support (e.g., a second side of the apron support). The two apron ends may be disposed facing each other on opposite ends of the apron support.

One of the two apron ends may be welded to a first side of the apron support with the flat open end of the second apron end disposed adjacent the inner side of the second table leg. The other one of the two apron ends may be welded to a second side of the apron support with the flat open end disposed adjacent the inner side of the first table leg. Each of the plurality of aprons may be configured to support the heavy-duty table between two table legs.

The apron support may be mounted on the bottom side of the tabletop between the inner side of the first table leg and the inner side of the second table leg. The apron support may enable the tote tray holder to be mounted to the bottom side of the tabletop. The mounting of the tote tray to the bottom side of the tabletop may be independent of interference from the apron support. The apron support may not interfere with the mounting of the tote tray holder.

A horizontal length from one edge of the flat top portion to another edge of the flat top portion may be about 300.0 mm. A vertical length from one edge of the elongated portion to another edge of the elongated portion of each of the two side portions may be about 23.1 mm. A vertical length from one edge of the c-shaped detent to another edge of the c-shaped detent of each of the two side portions may be about 20.0 mm. A horizontal length from one edge of the c-shaped detent to another edge of the c-shaped detent of each of the two side portions may be about 15.0 mm.

The tote tray holder may have the following dimensions. The horizontal length from one edge of the flat top portion to another edge of the flat top portion may be in the range of about 285.0 to about 315.0 mm. The vertical length from one edge of the elongated portion to another edge of the elongated portion of each of the two side portions may be in the range of about 21.9 to about 24.3 mm. The vertical length from one edge of the c-shaped detent to another edge of the c-shaped detent of each of the two side portions may be in the range of about 19.0 to about 21.0 mm. The horizontal length from one edge of the c-shaped detent to another edge of the c-shaped detent of each of the two side portions may be in the range of about 14.2 to about 15.8 mm.

The wheelchair-accessible heavy-duty table may include four corners. The wheelchair-accessible heavy-duty table may include four table legs. Each of the table legs may correspond to one of the four corners. The wheelchair-accessible heavy-duty table may include four aprons. Each of the four aprons may be disposed between two table legs. Two of the four aprons may have a first length. Two of the four aprons may have a second length. Each of the four aprons may be configured to support the tabletop between two table legs.

The wheelchair-accessible heavy-duty table may include four corner brackets. Each of the four corner brackets configured to be mounted to a table leg. Each of the four corner brackets configured to be mounted to an apron end from a first apron disposed adjacent a first inner side of the table leg. Each of the four corner brackets configured to be mounted to an apron end from a second apron disposed adjacent a second inner side of the table leg.

The wheelchair-accessible heavy-duty table may be ADA compliant. The tote tray holder may be ADA compliant.

The tote tray holder may include a single sheet of metal. The c-shaped detent of each of the two side portions of the tote tray holder may be configured with a fold tab. The fold tab may hold the tote tray level when the tote tray is pulled out up to about 2 inches before the end of the tote tray. The fold tab may be located at the distal end of the tote tray holder with respect to the user. The c-shaped detent of each of the two side portions may include at least two 90° angles.

The c-shaped detent of each of the two side portions of the tote tray holder may include a stability ridge at the edge of the c-shaped detent. The stability ridge at the edge of the c-shaped detent may keep the tote tray from falling out. The stability ridge may have a maximum height of about 2.5 mm.

A method for mounting a tote tray holder to a wheelchair-accessible heavy-duty table is provided. The method may include forming a tabletop. The tabletop may include a plurality of corners.

The method may include forming a plurality of legs. Each of the table legs may be disposed at a corresponding one of the plurality of corners of the tabletop. For example, if a tabletop is a hexagonal shape, the heavy-duty table may include six legs, each of the six table legs disposed at a corner of the hexagonal tabletop.

Each of the plurality of table legs may include a first inner side and a second inner side. Each of the plurality of table legs may include a first outer side and second outer side. The first inner side and second inner side may intersect at a 90° angle. The first outer side may intersect the first inner side at a 90° angle. The first outer side may intersect the second outer side at a 90° angle. The second outer side may intersect the second inner side at a 90° angle. The first and second inner sides may be the sides of the table leg that faces toward an area defined by an underside of the tabletop. The first and second outer sides may be the sides of the table leg that faces the away from the area defined by the underside of the tabletop.

In some of the embodiments, the plurality of table legs may not include sides. The plurality of table legs may be circular.

The plurality of table legs may be height adjustable table legs. The adjustable height table legs may enable an adjustable table. The adjustable table may enable the adjustment of the height of the tabletop in relation to the ground.

The method may include attaching a tote tray holder to the tabletop. The tote tray holder may include a metal frame. The metal frame may include a flat top portion. The metal frame may include two side portions. Each of the two side portions may include an elongated portion. Each of the two side portions may include a c-shaped detent. The flat top portion may be configured to be mounted to the bottom side of the tabletop. The two side portions may be configured to slidably engage in respective edges of a tote tray.

The tote tray holder may include sheet metal. The sheet metal may include 14-gauge steel or any other suitable gauge steel. Sheet metal may include any suitable material.

The method may include forming a wheelchair-accessible heavy-duty table including a different amount of tote tray holders per size table. For example, a table with 30-, 36-, and 42-inch width may include up to 1 tote tray holder. A table with 48-, 54-, and 60-inch width may include up to 2 tote tray holders. A table with 72- and 84-inch width may include up to 3 tote tray holders. And a table with 96-inch width may include up to 4 tote tray holders.

The method may include forming a plurality of aprons. The plurality of aprons may be table supports. Each of the plurality of aprons may include an apron support. The apron support may include sheet metal. The sheet metal may include 3-gauge steel. Sheet metal may include any suitable material.

The apron support may be mounted to the bottom side of the tabletop. The apron support may be mounted between the inner side of the first table leg and an inner side of the second table leg. The apron support may be mounted to the bottom side of the tabletop using screws.

Each of the aprons may include two apron ends. Each of the two apron ends may include angular metal tubing. The angular metal tubing may include 13.5-gauge steel or any other suitable gauge steel. The angular metal tubing may include any other suitable material. Each of the apron ends may include a first side surface. Each of the apron ends may include a second side surface. The first side surface may be parallel to the second side surface. Each of the apron ends may include a bottom surface. The bottom surface may connect to the bottom edge of the first side surface and the bottom edge of the second side. Each of the apron ends may include a flat open end. The flat open end may be defined by an intersection of the first side surface, the second side surface and the bottom surface. Each of the apron ends may include a curved open end. The curved open end may be opposite the flat open end. The curved open end may be defined by a curved end of the first side surface, a curved end of the second side surface and an edge of the bottom surface. Each of the apron ends may include a top side. The top side may be parallel with the bottom side. The top side may be an open side defined by an edge of the first side surface and an edge of the second side surface.

Each of the two apron ends may include an apron end cover. The apron end cover may be welded to the curved end of the first side surface, the curved end of the second side surface, and an edge of the bottom surface. Following the welding, the apron end cover may convert the curved open end to a curved closed end.

One of the two apron ends may be welded to the apron support with the flat open end disposed adjacent the inner side of the first table leg. The other one of the two apron ends may be welded to the apron support with the flat open end disposed adjacent the inner side of the second table leg. One of the two apron supports may be welded to the apron support on one end of the apron support. The other one of the two apron ends may be welded to the other end of the apron support. The two apron ends may be disposed facing each other on opposite ends of the apron support.

One of the two apron ends may be welded to a first side of the apron support with the flat open end of the second apron end disposed adjacent the inner side of the second table leg. The other one of the two apron ends may be welded to a second side of the apron support with the flat open end disposed adjacent the inner side of the first table leg. Each of the plurality of aprons may be configured to support the heavy-duty table between two table legs.

The apron support may be mounted on the bottom side of the tabletop between the inner side of the first table leg and the inner side of the second table leg. The apron support may enable the tote tray holder to be mounted to the bottom side of the tabletop. The mounting of the tote tray to the bottom side of the tabletop may be independent of interference from the apron support. The apron support may not interfere with the mounting of the tote tray holder.

The tote tray holder may have the following dimensions. A horizontal length from one edge of the flat top portion to another edge of the flat top portion may be about 300.0 mm. A vertical length from one edge of the elongated portion to another edge of the elongated portion of each of the two side portions may be about 23.1 mm. A vertical length from one edge of the c-shaped detent to another edge of the c-shaped detent of each of the two side portions may be about 20.0 mm. A horizontal length from one edge of the c-shaped detent to another edge of the c-shaped detent of each of the two side portions may be about 15.0 mm.

The horizontal length from one edge of the flat top portion to another edge of the flat top portion may be in the range of about 285.0 to about 315.0 mm. The vertical length from one edge of the elongated portion to another edge of the elongated portion of each of the two side portions may be in the range of about 21.9 to about 24.3 mm. The vertical length from one edge of the c-shaped detent to another edge of the c-shaped detent of each of the two side portions may be in the range of about 19.0 to about 21.0 mm. The horizontal length from one edge of the c-shaped detent to another edge of the c-shaped detent of each of the two side portions may be in the range of about 14.2 to about 15.8 mm.

The method may include forming four corners on the wheelchair-accessible heavy-duty table. The method may include forming four table legs. Each of the table legs may correspond to one of the four corners. The method may include forming four aprons. Each of the four aprons may be disposed between two table legs. Two of the four aprons may have a first length. Two of the four aprons may have a second length. Each of the four aprons may be configured to support the tabletop.

The method may include forming four corner brackets. Each of the four corner brackets configured to be mounted to a table leg. Each of the four corner brackets configured to be mounted to an apron end from a first apron disposed adjacent a first inner side of the table leg. Each of the four corner brackets configured to be mounted to an apron end from a second apron disposed adjacent a second inner side of the table leg.

The method may include mounting the four aprons to the bottom side of the tabletop. The method may include mounting the four aprons to the bottom side of the tabletop using screws.

The method may include forming the tote tray holder from a single sheet of metal. The c-shaped detent of each of the two side portions of the tote tray holder may be configured with a fold tab. The fold tab may hold the tote tray level when the tote tray is pulled out up to about 2 inches before the end of the tote tray. The fold tab may be located at the distal end of the tote tray holder with respect to the user. The c-shaped detent of each of the two side portions may include at least two 90° angles.

The c-shaped detent of each of the two side portions of the tote tray holder may include a stability ridge at the edge of the c-shaped detent. The stability ridge at the edge of the c-shaped detent may keep the tote tray from falling out. The stability ridge may have a maximum height of about 2.5 mm.

All ranges and parameters disclosed herein shall be understood to encompass any and all subranges subsumed therein, every number between the endpoints, and the endpoints. For example, a stated range of "1 to 10" should be considered to include any and all subranges between (and inclusive of) the minimum value of 1 and the maximum value of 10; that is, all subranges beginning with a minimum value of 1 or more (e.g., 1 to 6.1), and ending with a maximum value of 10 or less (e.g., 2.3 to 10.4, 3 to 8, 4 to 7), and finally to each number 1, 2, 3, 4, 5, 6, 7, 8, 9, and 10 contained within the range.

Apparatus and methods described herein are illustrative. Apparatus and methods in accordance with this disclosure will now be described in connection with the figures, which form a part hereof. The figures show illustrative features of apparatus and method steps in accordance with the principles of this disclosure. It is understood that other embodiments may be utilized, and that structural, functional, and procedural modifications may be made without departing from the scope and spirit of the present disclosure.

Methods for designing, rendering, and producing the disclosed apparatus are also disclosed. Designing and/or rendering the disclosed apparatus may include creating a digital image based on specification inputs. The specification inputs may include components and/or dimensions disclosed herein.

The steps of methods may be performed in an order other than the order shown and/or described herein. Embodiments may omit steps shown and/or described in connection with illustrative methods. Embodiments may include steps that are neither shown nor described in connection with illustrative methods.

Illustrative method steps may be combined. For example, an illustrative method may include steps shown in connection with another illustrative method.

Apparatus may omit features shown and/or described in connection with illustrative apparatus. Embodiments may include features that are neither shown nor described in connection with the illustrative apparatus. Features of illustrative apparatus may be combined. For example, an illustrative embodiment may include features shown in connection with another illustrative embodiment.

The drawings show illustrative features of apparatus and methods in accordance with the principles of the invention. The features are illustrated in the context of selected embodiments. It will be understood that features shown in connection with one of the embodiments may be practiced in accordance with the principles of the invention along with features shown in connection with another of the embodiments.

One of ordinary skill in the art will appreciate that the steps shown and described herein may be performed in other than the recited order and that one or more steps illustrated may be optional. The methods of the above-referenced embodiments may involve the use of any suitable elements, steps, computer-executable instructions, or computer-readable data structures. In this regard, other embodiments are disclosed herein as well that can be partially or wholly implemented on a computer-readable medium, for example, by storing computer-executable instructions or modules or by utilizing computer-readable data structures. For example, methods for producing an apparatus may, in certain embodiments, be wholly or partially executed by designing the apparatus via software, such as computer aided design ("CAD") software.

Thus, methods and systems for a tote tray holder and associated tote tray holder mechanisms are provided. Persons skilled in the art will appreciate that the present invention can be practiced by other than the described embodiments, which are presented for purposes of illustration rather than of limitation, and that the present invention is limited only by the claims that follow.

What is claimed is:

1. A wheelchair-accessible heavy-duty table, the wheelchair-accessible heavy-duty table comprising:

a tabletop, comprising a plurality of corners;

a plurality of table legs, each of the table legs disposed at a corresponding one of the plurality of corners, each of the plurality of table legs comprising a first inner side and a second inner side, the first inner side and second inner side configured to intersect at a 90° angle;

a tote tray holder:

including a metal frame comprising a flat top portion, two side portions, each of the two side portions including an elongated portion and a c-shaped detent;

wherein:

the flat top portion is configured to be mounted to a bottom side of the tabletop; and the two side portions are configured to slidably engage in respective edges of a tote tray; and a plurality of aprons, the plurality of aprons including:

an apron support, the apron support:

formed from sheet metal;

configured to be mounted on a bottom side of the tabletop between an inner side of a first table leg and an inner side of a second table leg; and enabling the tote tray holder to be mounted to the bottom side of the tabletop, independent of interference from the apron support; and two apron ends, each of the apron ends including:

angular metal tubing having a first side surface, a second side surface, a bottom surface, a flat open end, a curved open end, and two edges; and an apron end cover, the apron end cover configured to be welded to the first side surface, the second side surface, and the bottom surface, following a welding the apron end cover converting the curved open end to a curved closed end; wherein:

the top two edges of a first apron end are configured to be welded to a first side of the apron support with the flat open end of the first apron end configured to be disposed adjacent the inner side of the first table leg; and the top two edges of a second apron end are configured to be welded to a second side of the apron support with the flat open end of the second apron end disposed adjacent the inner side of the second table leg;

wherein each of the plurality of aprons is configured to support the wheelchair-accessible heavy-duty table.

2. The wheelchair-accessible heavy-duty table of claim 1 wherein a horizontal length from one edge of the flat top portion to another edge of the flat top portion is about 300.0 millimeters ("mm"), a vertical length from one edge of the elongated portion to another edge of the elongated portion of each of the two side portions is about 23.1 mm, a vertical length from one edge of the c-shaped detent to another edge of the c-shaped detent of each of the two side portions is about 20.0 mm, and a horizontal length from one edge of the c-shaped detent to another edge of the c-shaped detent of each of the two side portions is about 15.0 mm.

3. The wheelchair-accessible heavy-duty table of claim 1 wherein a horizontal length from one edge of the flat top portion to another edge of the flat top portion is in a range of about 285.0 to about 315.0 millimeters ("mm"), a vertical length from one edge of the elongated portion to another edge of the elongated portion of each of the two side portions is in a range of about 21.9 to about 24.3 mm, a vertical length from one edge of the c-shaped detent to another edge of the c-shaped detent of each of the two side portions is in a range of about 19.0 to about 21.0 mm, and a horizontal length from one edge of the c-shaped detent to another edge of the c-shaped detent of each of the two side portions is in a range of about 14.2 to about 15.8 mm.

4. The wheelchair-accessible heavy-duty table of claim 1 wherein the wheelchair-accessible heavy-duty table further includes:

four corners;

four table legs, each of the table legs corresponding to one of the four corners;

four aprons, each of the four aprons disposed between two table legs; wherein:

two of the four aprons have a first length; and two of the four aprons have a second length.

5. The wheelchair-accessible heavy-duty table of claim 4 further including four corner brackets, each of the four the corner brackets configured to be mounted to:

a table leg;

an apron end from a first apron disposed adjacent a first inner side of the table leg; and an apron end from a second apron disposed adjacent a second inner side of the table leg.

6. The wheelchair-accessible heavy-duty table of claim 1 wherein the tote tray holder comprises a single sheet of metal.

7. The wheelchair-accessible heavy-duty table of claim 1 wherein the c-shaped detent of each of the two side portions of the tote tray holder is further configured with a fold tab to hold level a tote tray when the tote tray is pulled out up to about 2 inches before an end of the tote tray.

8. The wheelchair-accessible heavy-duty table of claim 1 wherein the c-shaped detent of each of the two side portions includes at least two 90° angles.

9. The wheelchair-accessible heavy-duty table of claim 8 the c-shaped detent of each of the two side portions of the tote tray holder includes a stability ridge at an edge of the c-shaped detent to keep a tote tray from falling out, the stability ridge having a maximum height of about 2.5 mm.

10. A method for mounting a tote tray holder to a wheelchair-accessible heavy-duty table, the method comprising:

forming a tabletop, comprising a plurality of corners;

forming a plurality of table legs, each of the table legs disposed at a corresponding one of the plurality of corners, each of the plurality of table legs comprising a first inner side and a second inner side, the first inner side and second inner side configured to intersect at a 90° angle;

attaching a tote tray holder to the tabletop, the tote tray holder:

including a metal frame comprising a flat top portion, two side portions, each of the two side portions including an elongated portion and a c-shaped detent;

wherein:

the flat top portion is configured to be mounted to a bottom side of the tabletop; and the two side portions are configured to slidably engage in respective edges of a tote tray; and forming a plurality of aprons, the plurality of aprons including:

an apron support, the apron support:

formed from sheet metal;

configured to be mounted on a bottom side of the tabletop between an inner side of a first table leg and an inner side of a second table leg; and enabling the tote tray holder to be mounted to the bottom side of the tabletop, independent of interference from the apron support; and two apron ends, each of the apron ends including:

angular metal tubing having a first side surface, a second side surface, a bottom surface, a flat open end, a curved open end, and two edges; and an apron end cover, the apron end cover configured to be welded to the first side surface, the second side surface, and the bottom surface, following a welding the apron end cover converting the curved open end to a curved closed end; wherein:

the top two edges of a first apron end are configured to be welded to a first side of the apron support with the flat open end of the first apron end configured to be disposed adjacent the inner side of the first table leg; and the top two edges of a second apron end are configured to be welded to a second side of the apron support with the flat open end of the second apron end disposed adjacent the inner side of the second table leg;

wherein each of the plurality of aprons is configured to support the wheelchair-accessible heavy-duty table.

11. The method of claim 10 wherein a horizontal length from one edge of the flat top portion to another edge of the flat top portion is about 300.0 millimeters ("mm"), a vertical length from one edge of the elongated portion to another edge of the elongated portion of each of the two side portions is about 23.1 mm, a vertical length from one edge of the c-shaped detent to another edge of the c-shaped detent of each of the two side portions is about 20.0 mm, and a horizontal length from one edge of the c-shaped detent to another edge of the c-shaped detent of each of the two side portions is about 15.0 mm.

12. The method of claim 10 wherein a horizontal length from one edge of the flat top portion to another edge of the flat top portion is in a range of about 285.0 to about 315.0 millimeters ("mm"), a vertical length from one edge of the elongated portion to another edge of the elongated portion of each of the two side portions is in a range of about 21.9 to about 24.3 mm, a vertical length from one edge of the c-shaped detent to another edge of the c-shaped detent of each of the two side portions is in a range of about 19.0 to about 21.0 mm, and a horizontal length from one edge of the c-shaped detent to another edge of the c-shaped detent of each of the two side portions is in a range of about 14.2 to about 15.8 mm.

13. The method of claim 10 including forming four aprons wherein the four aprons are further configured to be mounted to a wheelchair-accessible heavy-duty table, the wheelchair-accessible heavy-duty table comprising:

a tabletop including four corners;

four table legs, each of the table legs corresponding to one of the four corners, each of the four of table legs comprising a first inner side and a second inner side, the first inner side and second inner side configured to intersect at a 90° angle; wherein:

each of the four aprons are configured to be mounted:

to a bottom side of the tabletop; and between the first inner side of a one table leg and the second inner side of another table leg;

two of the four aprons have a first length; and two of the four aprons have a second length.

14. The method of claim 13 wherein the wheelchair-accessible heavy-duty table further includes four corner brackets, each of the four the corner brackets configured to be mounted to:

a table leg;

an apron end from a first apron disposed adjacent a first inner side of the table leg; and an apron end from a second apron disposed adjacent a second inner side of the table leg.

15. The method of claim 13 wherein the four aprons are further configured to be mounted to the bottom side of the tabletop using screws.

16. The method of claim 10 wherein the tote tray holder comprises a single sheet of metal.

17. The method of claim 10 wherein the c-shaped detent of each of the two side portions of the tote tray holder is further configured with a fold tab to hold level a tote tray when the tote tray is pulled out up to about 2 inches before an end of the tote tray.

18. The method of claim 10 wherein the c-shaped detent of each of the two side portions includes at least two 90° angles.

19. The method of claim 18 wherein the c-shaped detent of each of the two side portions of the tote tray holder includes a stability ridge at an edge of the c-shaped detent to keep a tote tray from falling out, the stability ridge having a maximum height of about 2.5 mm.

* * * * *